US008769844B2

(12) United States Patent
Beers et al.

(10) Patent No.: US 8,769,844 B2
(45) **Date of Patent: *Jul. 8, 2014**

(54) AUTOMATIC LACING SYSTEM

(71) Applicant: Nike, Inc., Beaverton, OR (US)

(72) Inventors: Tiffany A. Beers, Portland, OR (US); Michael R. Friton, Portland, OR (US); Tinker L. Hatfield, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/955,007

(22) Filed: Jul. 31, 2013

(65) Prior Publication Data

US 2014/0026440 A1 Jan. 30, 2014

Related U.S. Application Data

(60) Continuation of application No. 13/236,221, filed on Sep. 19, 2011, now Pat. No. 8,522,456, which is a division of application No. 12/114,022, filed on May 2, 2008, now Pat. No. 8,046,937.

(51) Int. Cl.
*A43C 11/00* (2006.01)

(52) U.S. Cl.
USPC ..... 36/50.1

(58) Field of Classification Search
USPC ..... 36/50.1, 50.5; 24/68 SK
See application file for complete search history.

(56) References Cited

U.S. PATENT DOCUMENTS 3,070,907 A 1/1963 Rocco
3,496,505 A 2/1970 Dana, III
3,893,247 A 7/1975 Dana, III
4,020,572 A 5/1977 Chiaramonte, Jr.
4,158,922 A 6/1979 Dana, III
4,253,253 A 3/1981 McCormick
4,426,796 A 1/1984 Spademan
4,433,456 A 2/1984 Baggio
4,494,324 A 1/1985 Spademan
4,619,057 A * 10/1986 Sartor et al. ..... 36/50.5
4,644,671 A 2/1987 Walkhoff
4,670,999 A 6/1987 Olivieri
4,895,110 A 1/1990 LoCascio
4,924,605 A 5/1990 Spademan
4,999,936 A 3/1991 Calamia et al.
5,060,402 A 10/1991 Rosen
5,174,051 A * 12/1992 Walkhoff et al. ..... 36/118.9
5,188,447 A 2/1993 Chiang et al.
5,205,055 A * 4/1993 Harrell ..... 36/50.1
5,245,516 A 9/1993 de Haas et al.
5,285,586 A 2/1994 Goldston et al.
5,303,131 A 4/1994 Wu (Continued)

OTHER PUBLICATIONS

Extended European Search Report dated Mar. 13, 2014 in European Patent Application No. 09 739 662.6.

(Continued)

*Primary Examiner* — Ted Kavanaugh

(74) *Attorney, Agent, or Firm* — Plumsea Law Group, LLC

(57) ABSTRACT

An article of footwear with an automatic lacing system is disclosed. The automatic lacing system provides a set of straps that can be automatically opened and closed to switch between a loosened and tightened position of the upper. The article further includes an automatic ankle cinching system that is configured to automatically adjust an ankle portion of the upper.

20 Claims, 16 Drawing Sheets

(56) References Cited

U.S. PATENT DOCUMENTS

| | | | | |
|---|---|---|---|---|
| 5,303,485 | A | 4/1994 | Goldston et al. | |
| 5,311,677 | A | 5/1994 | Mann et al. | |
| 5,311,678 | A | 5/1994 | Spademan | |
| 5,373,651 | A | 12/1994 | Wood | |
| 5,396,718 | A | 3/1995 | Schuler et al. | |
| 5,469,342 | A | 11/1995 | Chien | |
| 5,479,325 | A | 12/1995 | Chien | |
| 5,495,136 | A | 2/1996 | Chiang et al. | |
| 5,500,635 | A | 3/1996 | Mott | |
| 5,546,681 | A | 8/1996 | Goldston et al. | |
| 5,570,945 | A | 11/1996 | Chien et al. | |
| 5,611,621 | A | 3/1997 | Chien | |
| 5,644,858 | A | 7/1997 | Bemis | |
| 5,692,324 | A | 12/1997 | Goldston et al. | |
| 5,704,705 | A | 1/1998 | Chien | |
| 5,704,706 | A | 1/1998 | Goldston et al. | |
| 5,829,169 | A | 11/1998 | James | |
| 5,839,210 | A * | 11/1998 | Bernier et al. | 36/50.1 |
| 5,865,523 | A | 2/1999 | Chien | |
| 5,950,335 | A | 9/1999 | Okajima | |
| 5,983,530 | A | 11/1999 | Chou | |
| 6,032,387 | A * | 3/2000 | Johnson | 36/50.1 |
| 6,035,556 | A | 3/2000 | Ballinger et al. | |
| 6,199,305 | B1 | 3/2001 | Steuerwald et al. | |
| 6,378,230 | B1 | 4/2002 | Rotem et al. | |
| 6,427,361 | B1 | 8/2002 | Chou | |
| 6,643,954 | B2 | 11/2003 | Voswinkel | |
| 6,691,433 | B2 | 2/2004 | Liu | |
| 6,896,128 | B1 * | 5/2005 | Johnson | 36/50.1 |
| 6,925,734 | B1 | 8/2005 | Schaeffer | |
| 6,952,891 | B2 | 10/2005 | Hirayama | |
| 7,059,069 | B2 | 6/2006 | Raluy et al. | |
| 7,103,994 | B2 | 9/2006 | Johnson | |
| 7,255,468 | B2 | 8/2007 | Capriola | |
| 7,395,614 | B1 | 7/2008 | Bailey, Sr. et al. | |
| 7,503,131 | B2 * | 3/2009 | Nadel et al. | 36/50.5 |
| 7,510,293 | B2 | 3/2009 | Chyn | |
| 7,752,774 | B2 * | 7/2010 | Ussher | 36/50.1 |
| 7,794,101 | B2 | 9/2010 | Galica et al. | |
| 8,046,937 | B2 * | 11/2011 | Beers et al. | 36/50.1 |
| 8,056,269 | B2 | 11/2011 | Beers et al. | |
| 8,058,837 | B2 | 11/2011 | Beers et al. | |
| 8,522,456 | B2 | 9/2013 | Beers et al. | |
| 2003/0066207 | A1 | 4/2003 | Gaither | |
| 2005/0198867 | A1 | 9/2005 | Labbe | |
| 2005/0235523 | A1 | 10/2005 | Flechsig et al. | |
| 2006/0002134 | A1 | 1/2006 | Capriola | |
| 2006/0156517 | A1 | 7/2006 | Hammerslag et al. | |
| 2007/0011914 | A1 | 1/2007 | Keen et al. | |
| 2007/0011919 | A1 | 1/2007 | Case, Jr. | |
| 2007/0028486 | A1 | 2/2007 | Montanya et al. | |
| 2007/0267398 | A1 | 11/2007 | McCoy et al. | |
| 2008/0054845 | A1 | 3/2008 | Wang | |
| 2008/0060224 | A1 | 3/2008 | Whittlesey et al. | |
| 2008/0086911 | A1 * | 4/2008 | Labbe | 36/50.1 |
| 2008/0197126 | A1 | 8/2008 | Bourke et al. | |
| 2008/0246439 | A1 | 10/2008 | Tsui et al. | |
| 2009/0272007 | A1 | 11/2009 | Beers et al. | |
| 2010/0033321 | A1 | 2/2010 | Kaminski et al. | |
| 2010/0115799 | A1 | 5/2010 | Welter et al. | |

OTHER PUBLICATIONS

International Seach Report and Written Opinion, mailed Jul. 27, 2009, from PCT Application No. PCT/US2009/42072.

International Seach Report and Written Opinion, mailed Jul. 27, 2009, from PCT Application No. PCT/US2009/42075.

Notification Concerning Transmittal of International Preliminary Report on Patentability, mailed Nov. 11, 2010, from PCT Application No. PCT/US2009/042075.

Notification Concerning Transmittal of International Preliminary Report on Patentability, mailed Nov. 11, 2010, from PCT Application No. PCT/US2009/042072.

Back to the Future Part II (Universal Pictures 1989), first appearance of shoes at 8:06, see also Feature Commentary with Producers Bob Gale and Neil Canton at 8:06-8:32.

International Search Report and Written Opinion mailed Feb. 14, 2012 in PCT Application No. PCT/US2009/42081.

International Preliminary Report on Patentability (including Written Opinion of the ISA) mailed Mar. 15, 2012 in International Application No. PCT/US2009/042081.

Extended European Search Report dated Nov. 28, 2013 in European Patent Application No. 09 739 660.0.

Extended European Search Report dated Feb. 18, 2014 in European Patent Application No. 09 739 666.7.

* cited by examiner

AUTOMATIC LACING SYSTEM

CROSS-REFERENCE TO RELATED APPLICATIONS

This application is a continuation of U.S. Pat. No. 8,522,456, currently U.S. application Ser. No. 13/236,221, entitled "Automatic Lacing System", filed on Sep. 19, 2011, and issued on Sep. 3, 2013, which application is a division of U.S. Pat. No. 8,046,937, currently U.S. application Ser. No. 12/114,022, entitled "Automatic Lacing System", filed on May 2, 2008, and issued on Nov. 1, 2011, which applications are hereby incorporated by reference in their entirety.

BACKGROUND

The present invention relates generally to footwear, and in particular the present invention relates to an automatic lacing system for an article of footwear.

Devices for automatically tightening an article of footwear have been previously proposed. Liu (U.S. Pat. No. 6,691,433) teaches an automated tightening shoe. The tightening mechanism of Liu includes a first fastener mounted on the upper, and a second fastener connected to the closure member and capable of removable engagement with the first fastener so as to retain releasably the closure member at a tightened state. Liu teaches a drive unit mounted in the heel portion of the sole. The drive unit includes a housing, a spool rotatably mounted in the housing, a pair of pull strings and a motor unit. Each string has a first end connected to the spool and a second end corresponding to a string hole in the second fastener. The motor unit is coupled to the spool. Liu teaches that the motor unit is operable so as to drive rotation of the spool in the housing to wind the pull strings on the spool for pulling the second fastener towards the first fastener. Liu also teaches a guide tube unit that the pull strings can extend through.

SUMMARY

The invention discloses an article of footwear including an automatic lacing system. In one aspect, the invention provides an automatic lacing system for an article of footwear, comprising: a sole including a cavity; a motor disposed in the cavity; the motor including a driveshaft; the driveshaft including at least one gear; at least one belt engaged with the at least one gear at an intermediate portion of the belt; a yoke member connected to the at least one belt at an attachment portion of the at least one belt; a plurality of straps attached to the yoke member, the plurality of straps being configured to adjust an upper of the article of footwear; and where the straps can be automatically moved between a closed position and a loosened position by activating the motor.

In another aspect, the yoke member is a rod.

In another aspect, the yoke member allows the plurality of straps to move substantially in unison.

In another aspect, the yoke member is disposed adjacent to a lower hole set of a rigid hollow plate when the straps are in the closed position.

In another aspect, the yoke member is disposed away from the lower hole set of the rigid hollow plate when the straps are in the closed position.

In another aspect, the driveshaft includes two gears.

In another aspect, the driveshaft includes two belts that are configured to engage the two gears.

In another aspect, the invention provides an automatic lacing system for an article of footwear, comprising: a strap moving mechanism; at least one strap attached to the strap moving mechanism, the at least one strap being configured to adjust an upper of the article of footwear; a rigid hollow plate associated with a sidewall portion of an upper; the rigid hollow plate configured to receive an intermediate portion of the at least one strap; and where the intermediate portion is contracted within the rigid hollow plate when the at least one strap is closed and wherein the intermediate portion is extended outside of the rigid hollow plate when the at least one strap is open.

In another aspect, the rigid hollow plate includes at least one strap receiving channel disposed within the rigid hollow plate.

In another aspect, the at least one strap receiving channel is configured to receive a portion of the at least one strap.

In another aspect, the strap receiving channel is configured to guide the portion of the at least one strap between a lower hole and an upper hole in the rigid hollow plate.

In another aspect, the rigid hollow plate includes a central hollow cavity.

In another aspect, the rigid hollow plate is disposed against an inner surface of the sidewall portion.

In another aspect, the rigid hollow plate is disposed against an outer surface of the sidewall portion.

In another aspect, the rigid hollow plate is disposed between an outer lining of the sidewall portion and an inner lining of the sidewall portion.

In another aspect, the strap moving mechanism further comprises: a motor including a driveshaft; the driveshaft including a gear; a belt configured to engage the gear; and where the belt is configured to supply power to the at least one strap.

In another aspect, the invention provides an automatic lacing system for an article of footwear, comprising: a first strap and a second strap configured to adjust an upper of an article of footwear, the first strap being disposed adjacent to the second strap; a strap moving mechanism connected to the first strap and the second strap, the strap moving mechanism being configured to automatically move the first strap and the second strap; and where the first strap and the second strap are configured to move substantially in unison when the strap moving mechanism is operated to automatically adjust the upper.

In another aspect, the spacing between adjacent portions of the first strap and the second strap is substantially constant.

In another aspect, the first strap and the second strap are attached to a yoke member that is configured to apply a force to the first strap and the second strap.

In another aspect, the first strap and the second strap are disposed beneath a lacing gap of the upper.

In another aspect, the first strap and the second strap oriented along a lateral direction of the upper.

In another aspect, the invention provides an automatic lacing system for an article of footwear, comprising: a strap moving mechanism; a strap including a first end portion attached to the strap moving mechanism and a second end portion attached to a sidewall portion of an upper of the article of footwear; and where the strap moving mechanism is configured to move the first end portion from a first position to a second position and thereby loosen the upper.

In another aspect, the strap moving mechanism is in communication with a sensor.

In another aspect, the sensor is a weight sensor.

In another aspect, the strap moving mechanism is configured to move the strap according to information received from the sensor.

In another aspect, the strap moving mechanism is in communication with a user controlled device.

In another aspect, the strap moving mechanism is configured to move the strap according to information received from the user controlled device.

In another aspect, the invention provides an automatic ankle cinching system for an article of footwear, comprising: an upper including an ankle portion; a housing disposed on a rear portion of the ankle portion; an ankle strap associated with a front portion of the ankle portion; an strap moving mechanism disposed within the housing; the strap including a first end portion attached to the strap moving mechanism and a second end portion fixedly attached to the housing; and where the strap moving mechanism is configured to automatically move the strap between an open position and a closed position and thereby adjust the ankle portion.

In another aspect, the strap moving mechanism includes a coil spring.

In another aspect, the coil spring provides tension to the first end portion.

In another aspect, the coil spring applies tension to the first end portion in a direction to automatically close the ankle strap.

In another aspect, the automatic ankle cinching system includes a locking mechanism that is configured to lock the ankle strap in an open position.

In another aspect, the locking mechanism is configured to receive information related to a weight sensor.

In another aspect, the locking mechanism is configured to release the ankle strap according to the information related to the weight sensor and thereby allow the ankle strap to move to a closed position and tighten around an ankle.

An automatic ankle cinching system for an article of footwear, comprising: an upper including an ankle portion; a housing disposed on a rear portion of the ankle portion; an ankle strap associated with a front portion of the ankle portion; the strap including a first end portion attached to the strap moving mechanism and a second end portion fixedly attached to the housing; the strap moving mechanism including a coil spring that is configured to wind within the housing, the coil spring being configured to wind around a shaft; where the shaft is oriented in a direction running from a top portion of the upper to a lower portion of the upper.

In another aspect, the first end portion of the ankle strap is attached to the coil spring.

In another aspect, the ankle strap is associated with a locking mechanism configured to restrict the movement of the ankle strap.

In another aspect, the housing includes a channel that is configured to receive the first end portion of the strap.

In another aspect, the housing includes a cavity configured to receive the coil spring.

In another aspect, the invention provides a method of adjusting an automatic lacing system of an article of footwear, comprising the steps of: receiving information from a user controlled device; and automatically opening an upper of the article of footwear using the automatic lacing system according to information received from the user controlled device.

In another aspect, the user controlled device is a button.

In another aspect, the user controlled device is a switch.

In another aspect, the step of receiving information from a user controlled device is followed by a step of receiving information from at least one sensor.

In another aspect, the automatic lacing system is controlled to close the upper according to information received from the at least one sensor.

In another aspect, the automatic lacing system is controlled to close the upper according to information received from the user controlled device.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
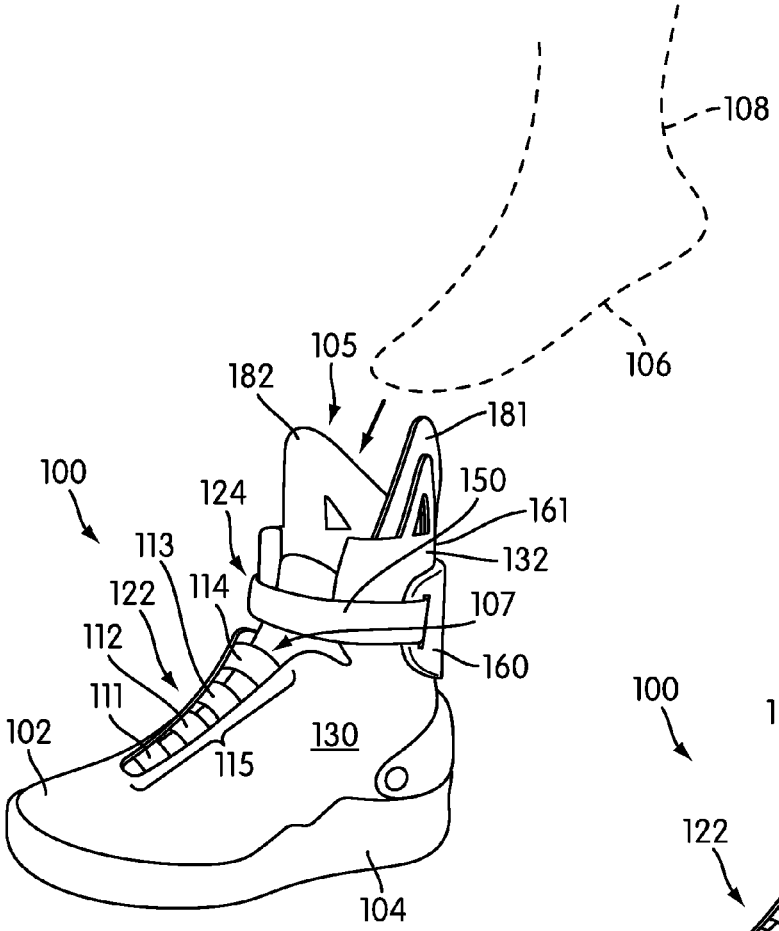
FIG. 1 is an isometric view of a preferred embodiment of an article of footwear in an open position.

FIG. 1 is a preferred embodiment of article of footwear 100, also referred to simply as article 100, in the form of an athletic shoe. For clarity, the following detailed description discusses a preferred embodiment, however, it should be kept in mind that the present invention could also take the form of any other kind of footwear, including, for example, skates, boots, ski boots, snowboarding boots, cycling shoes, formal shoes, slippers or any other kind of footwear.

Article 100 preferably includes upper 102. Upper 102 includes entry hole 105 that allows foot 106 to enter upper 102. Preferably, upper 102 also includes an interior cavity that is configured to receive foot 106. In particular, entry hole 105 preferably provides access to the interior cavity.

Preferably, upper 102 may be associated with sole 104. In a preferred embodiment, upper 102 is attached to sole 104. In some cases, upper 102 is connected to sole 104 by stitching or an adhesive. In other cases, upper 102 could be integrally formed with sole 104.

Preferably, sole 104 comprises a midsole. In some embodiments, sole 104 could also include an insole that is configured to contact a foot. In other embodiments, sole 104 could include an outsole that is configured to contact a ground surface. In a preferred embodiment, sole 104 may comprise a midsole as well as an outsole and an insole.

Generally, sole 104 may be provided with provisions for increasing traction depending on the intended application of article of footwear 100. In some embodiments, sole 104 may include a variety of tread patterns. In other embodiments, sole 104 may include one or more cleats. In still other embodiments, sole 104 could include both a tread pattern as well as a plurality of cleats. It should be understood that these provisions are optional. For example, in still another embodiment, sole 104 could have a generally smooth lower ground contacting surface.

Upper 102 may have any design. In some embodiments, upper 102 may have the appearance of a low top sneaker. In other embodiments, upper 102 may have the appearance of a high top sneaker. In this preferred embodiment, upper 102 may include a high ankle portion 132. In particular, upper 102 may include first extended portion 181 and second extended portion 182. In this embodiment, first extended portion 181 and second extended portion 182 have generally triangular shapes. In other embodiments, first extended portion 181 and second extended portion 182 could have another shape. Examples of other shapes include, but are not limited to, rounded shapes, rectangular shapes, polygonal shapes, regular shapes as well as irregular shapes. Using this configuration for ankle portion 132 may help provide upper 102 with additional support for an ankle.

Article 100 may include provisions for tightening upper 102 around foot 106. In some embodiments, article 100 may be associated with laces, straps and/or fasteners for tightening upper 102 once foot 106 has been inserted into upper 102. In some cases, article 100 may include laces, straps and/or fasteners that can be manually adjusted by a user. In a preferred embodiment, article 100 may include provisions for automatically adjusting laces, straps and/or other fasteners associated with upper 102. By using automatically adjusting laces, straps and/or other fasteners, upper 102 may be tightened around a foot with a minimal amount of effort from a user.

In some embodiments, upper 102 may include individual tightening systems associated with different portions of upper 102. In this exemplary embodiment, upper 102 may include automatic lacing system 122 that is associated with arch portion 130 of upper 102. Likewise, upper 102 may include automatic ankle cinching system 124 that is associated with ankle portion 132 of upper 102. Preferably, automatic lacing system 122 and automatic ankle cinching system 124 may be configured to automatically tighten and/or loosen upper 102 around foot 106 and ankle 108.

Automatic lacing system 122 preferably includes a plurality of straps. The term strap as used throughout this detailed description and in the claims refers to any device that can be used for tightening a portion of an article of footwear to a foot. Generally, a strap could have any shape. In some embodiments, a strap could have a rectangular or ribbon-like shape. However, it should be understood that the term strap is not intended to be restricted to tightening devices with ribbon-like shapes. In other embodiments, for example, a strap could have a lace-like shape. In still other embodiments, automatic lacing system 122 could be associated with other types of fasteners. Examples of other fasteners that could be used with automatic lacing system 122 include, but are not limited to laces, cords and strings.

Additionally, a strap could be made of any material. Examples of materials that could be used include, but are not limited to, leather, natural fabric, synthetic fabric, metal, rubber, as well as other materials. In some embodiments, a strap could be any type of woven strap as well. In particular, a strap could be woven from any material known in the art for producing woven straps.

Generally, automatic lacing system 122 can include any number of straps. In some embodiments, only a single strap may be provided. In other embodiments, multiple straps may be provided. In this embodiment, lacing system 122 includes four straps, including first strap 111, second strap 112, third strap 113 and fourth strap 114. For clarity, first strap 111, second strap 112, third strap 113 and fourth strap 114 may be referred to collectively as strap set 115.

In this embodiment, strap set 115 is disposed beneath lacing gap 107 of upper 102. Preferably, strap set 115 may be configured to adjust the size of lacing gap 107. As the size of lacing gap 107 is adjusted, the sidewall portions of upper 102 may move closer together or further apart. With this arrangement, as strap set 115 is adjusted, upper 102 can be opened and/or closed around the arch of foot 106.

Generally, strap set 115 may be arranged in any direction on upper 102. In some embodiments, strap set 115 could extend in a generally longitudinal direction. Preferably, strap set 115 may be arranged in a lateral direction with respect to upper 102. The term "lateral direction" as used in this detailed description and in the claims refers to a direction extending from a medial side of upper 102 to a lateral side of upper 102. In other words, the lateral direction preferably extends along the width of upper 102.

Furthermore, strap set 115 may include any type of spacing between adjacent straps. In some embodiments, the spacing between adjacent straps could vary. In other embodiments, one or more straps may cross over, or intersect with, one another. In a preferred embodiment, the straps of strap set 115 may be substantially evenly spaced. In particular, the width between adjacent portions of two straps remains substantially constant. In other words, the straps may be approximately parallel at adjacent portions.

Although automatic lacing system 122 is configured to tighten and/or loosen upper 102 at arch portion 130 in the current embodiment, in other embodiments, automatic lacing system 122 could be associated with another portion of upper 102. For example, in another embodiment, automatic lacing system 122 could be configured to tighten upper 102 at a side portion of upper 102. Additionally, automatic lacing system 122 could be associated with a toe portion of upper 102. In still another embodiment, automatic lacing system 122 could be associated with a heel portion of upper 102.

Automatic ankle cinching system 124 preferably includes at least one ankle strap. In some embodiments, automatic ankle cinching system 124 may include multiple ankle straps. In this preferred embodiment, automatic ankle cinching system 124 includes ankle strap 150. Ankle strap 150 could be any type of strap, including any type of strap previously discussed with respect to the straps of automatic lacing system 122. In some embodiments, ankle strap 150 could be a similar type of strap to the straps of strap set 115. In other embodiments, ankle strap 150 could be a different type of strap from the straps of strap set 115.

Preferably, automatic ankle cinching system 124 also includes provisions for receiving a portion of ankle strap 150. In this embodiment, automatic ankle cinching system 124 includes housing 160 that is configured to receive a portion of ankle strap 150. Housing 160 could be located anywhere on ankle portion 132 of upper 102. In some cases, housing 160 could be disposed on a side of ankle portion 132. In other cases, housing 160 could be disposed on at the front of ankle portion 132. In this preferred embodiment, housing 160 may be disposed on rear portion 161 of ankle portion 132.

Figure 2:
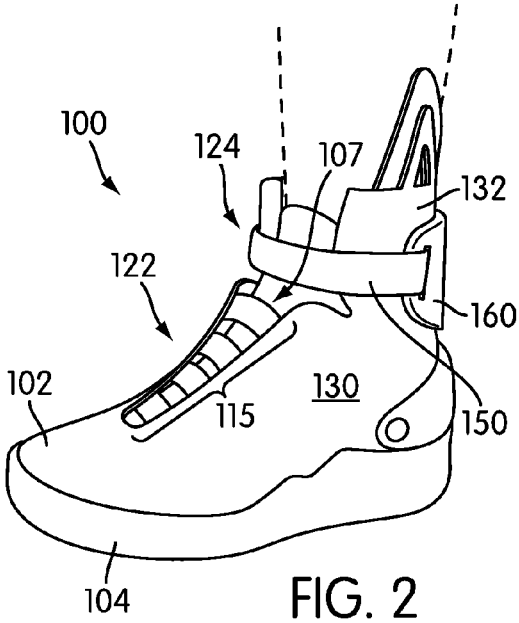
FIG. 2 is an isometric view of a preferred embodiment of an article of footwear with a foot inserted.
Figure 3:
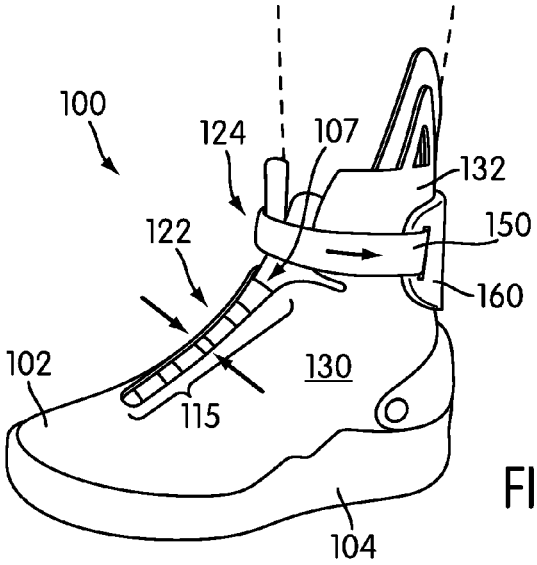
FIG. 3 is an isometric view of a preferred embodiment of an article of footwear in a closed position.

FIGS. 1-3 illustrate a preferred embodiment of the operation of automatic lacing system 122 and automatic ankle cinching system 124 of article 100. Initially, as seen in FIG. 1, article 100 may be configured to receive foot 106. In particular, automatic lacing system 122 and automatic ankle cinching system 124 may be each configured in an open position. In this open position, entry hole 105 may be wide open. Additionally, in this open position, lacing gap 107 may also be wide open. Preferably, this open position of automatic lacing system 122 and automatic ankle cinching system 124 may be associated with an open, or loosened, position of upper 102.

Referring to FIG. 2, foot 106 has been fully inserted into article 100. At this point, automatic lacing system 122 and automatic ankle cinching system 124 have not been activated. Therefore, upper 102 is not tightened around foot 106. Preferably, immediately following the insertion of foot 106 into upper 102, automatic lacing system 122 and automatic ankle cinching system 124 may be activated. In some cases, automatic lacing system 122 and automatic ankle cinching system 124 could be activated using one or more sensors to detect the presence of a foot. In other cases, automatic lacing system 122 and automatic ankle cinching system 124 could be activated using one or more user controlled devices, such as a button. Details of such provisions are discussed in further detail below.

Referring to FIG. 3, automatic lacing system 122 and automatic ankle cinching system 124 have been activated. In this closed position of automatic lacing system 122, arch portion 130 of upper 102 is preferably tightened around foot 106 (see FIG. 1). Likewise, in this closed position of automatic ankle cinching system 124, ankle portion 132 of upper 102 is preferably tightened around ankle 108 (see FIG. 1).

Figure 4:
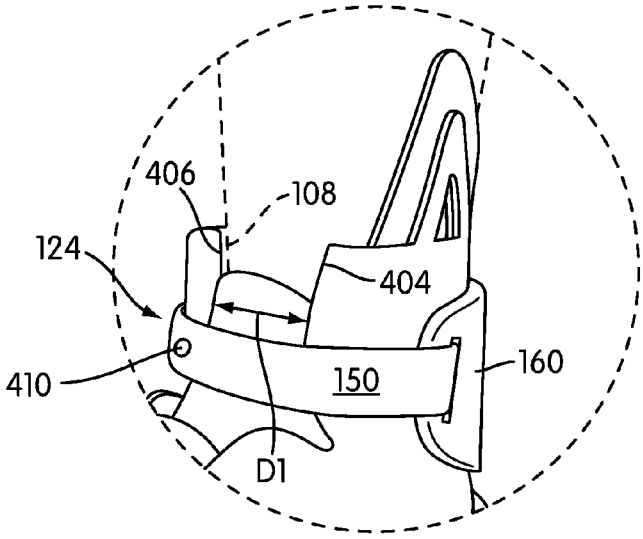
FIG. 4 is an enlarged view of a preferred embodiment of an automatic ankle cinching system in an open position.

FIGS. 4-9 further illustrate the fastening of automatic lacing system 122 and automatic ankle cinching system 124. Referring to FIG. 4, automatic ankle cinching system 124 is initially configured in an open position. In this open position, ankle strap 150 is generally loose. In particular, first ankle side wall portion 404 is separated from second ankle side wall portion 406 by a distance D1 that is much wider than the width of ankle 108. This arrangement preferably allows for easy insertion and/or removal of foot 106.

Figure 5:
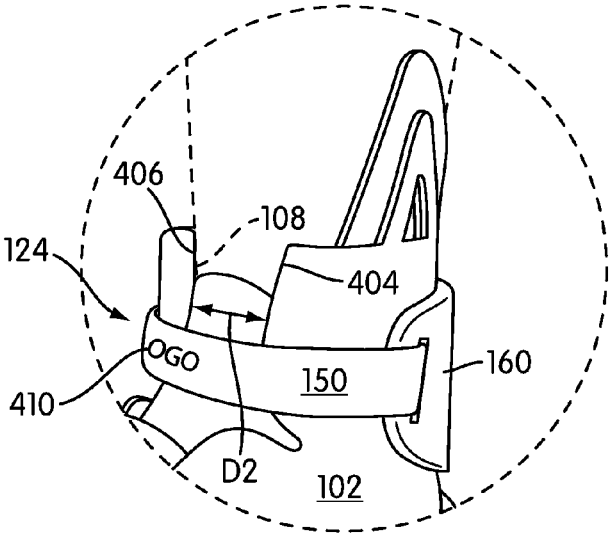
FIG. 5 is an enlarged view of a preferred embodiment of an automatic ankle cinching system closing around an ankle.

Referring to FIG. 5, as automatic ankle cinching system 124 begins to tighten around ankle 108, ankle strap 150 is partially contracted within housing 160. At this point, ankle strap 150 has partially constricted the movement of ankle 108 within upper 102. Furthermore, first ankle sidewall portion 404 is separated from second ankle side wall portion 406 by a distance D2 that is smaller than distance D1. In other words, first ankle sidewall portion 404 and second ankle sidewall portion 406 are slightly contracted against ankle 108 to partially restrict any movement of ankle 108.

Figure 6:
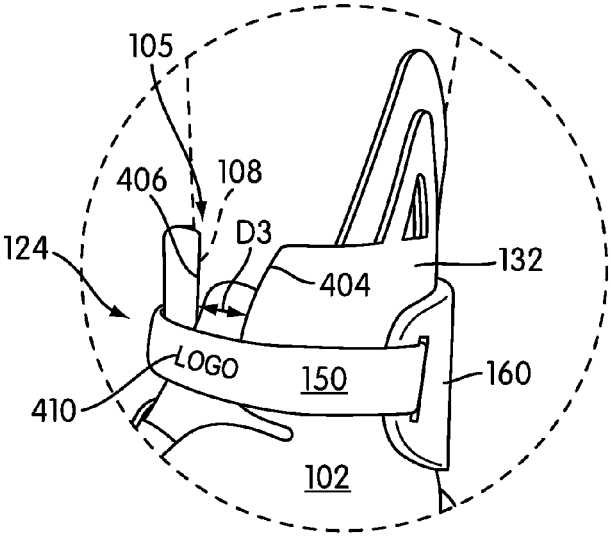
FIG. 6 is an enlarged view of a preferred embodiment of an automatic ankle cinching system in a closed position.

Referring to FIG. 6, automatic ankle cinching system 124 is in a closed position. In particular, ankle strap 150 has been fully tightened around ankle 108. At this point, ankle strap 150 is configured to prevent ankle 108 from moving laterally, as well as into or out of upper 102. First ankle sidewall portion 404 may be separated from second ankle sidewall portion 406 by a distance D3 that is substantially smaller than distance D2. Preferably, distance D3 is small enough to substantially restrict the motion of ankle 108. With this arrangement, ankle portion 132 of upper 102 may be tightened around ankle 108 to provide support to ankle 108 and to substantially contract the size of entry hole 105 to prevent removal of the foot.

In some embodiments, automatic ankle cinching system 124 could be provided with a logo or other type of indicia. In some cases, ankle strap 150 could be provided with a logo or other indicia. In other cases, another portion of automatic ankle cinching system 124 could include a logo or indicia. In this preferred embodiment, ankle strap 150 includes logo 410. As seen in FIGS. 4 through 6, as ankle strap 150 moves to tighten around ankle 108, logo 410 may move with ankle strap 150. With this preferred arrangement, when ankle strap 150 is disposed in a fully closed, or tightened, position, logo 410 may be oriented towards a front portion of the article of footwear.

Figure 7:
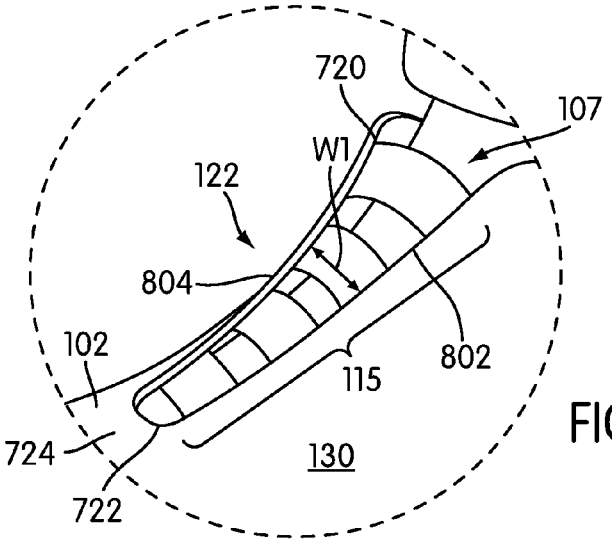
FIG. 7 is an enlarged view of a preferred embodiment of an automatic lacing system in an open position.

Referring to FIG. 7, automatic lacing system 122 is initially configured in an unfastened, or open, position. In this open position, strap set 115 is generally loose. In particular, first sidewall periphery 802 and second sidewall periphery 804 of lacing gap 107 may be spaced widely apart. At this point, lacing gap 107 has an average width W1. Preferably, average width W1 is wide enough to provide for easy insertion and/or removal of a foot.

It should be understood that the width of lacing gap 107 may be different along the length of arch portion 130. In some embodiments, lacing gap 107 may be generally widest at first portion 720 that is adjacent to entry hole 105 of upper 102. Likewise, lacing gap 107 may be narrowest at second portion 722 that is adjacent to toe portion 724 of upper 102. Therefore, the term "average width" as used throughout this detailed description and in the claims should be understood to mean an average of the width of lacing gap 107 over different portions and does not necessarily refer to the width of lacing gap 107 at a particular portion.

Figure 8:
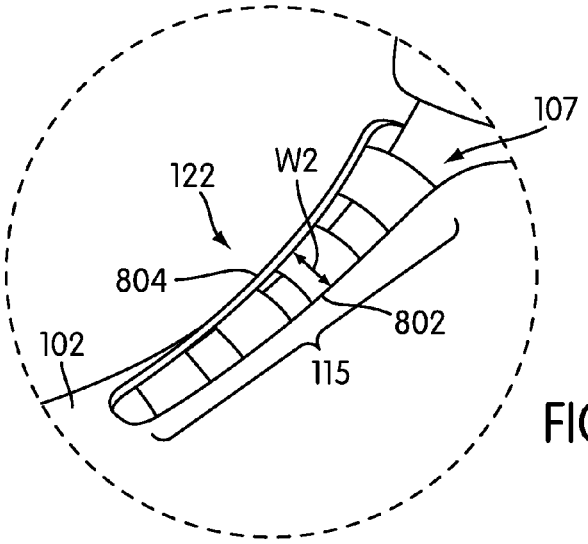
FIG. 8 is an enlarged view of a preferred embodiment of an automatic lacing system closing around a foot.

Referring to FIG. 8, as automatic lacing system 122 begins to tighten, lacing gap 107 may contract. In particular, strap set 115 may provide tension between first sidewall periphery 802 and second sidewall periphery 804 in order to partially close lacing gap 107. At this point, lacing gap 107 has an average width W2 that is substantially smaller than average width W1. Preferably, width W2 is small enough to partially restrict the movement of the foot within upper 102.

Figure 9:
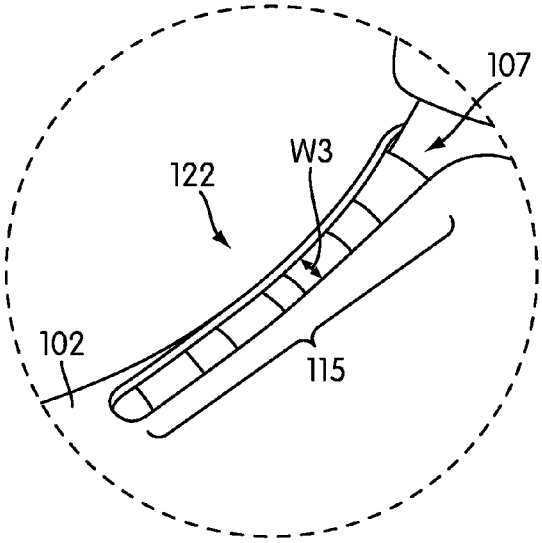
FIG. 9 is an enlarged view of a preferred embodiment of an automatic lacing system in a closed position.

Referring to FIG. 9, automatic lacing system 122 has been fully closed around the foot. At this point, strap set 115 is configured to prevent substantial movement of the foot within upper 102. In particular, lacing gap 107 has contracted to an average width W3 that is substantially smaller than average width W2. With this arrangement, upper 102 may be fully tightened around the foot and may provide increased support to the foot.

In some embodiments, upper 102 may be automatically loosened. In other embodiments, upper 102 may be loosened manually. In still other embodiments, a first portion of upper 102 may be automatically loosened and a second portion of upper 102 may be manually loosened. In a preferred embodiment, automatic lacing system 122 may be configured to be automatically loosened. Likewise, automatic ankle cinching system 124 may be manually loosened.

Preferably, article 100 may include provisions for automatically opening automatic lacing system 122, once a user is ready to remove article of footwear 100. In some cases, automatic lacing system 122 may automatically loosen following a signal received from a user. For example, in one embodiment, the user could press a button that causes automatic lacing system 122 to move to an open position, so that upper 102 is loosened around a foot. In other embodiments, automatic lacing system 122 may automatically move to an open position without user input.

Figure 10:
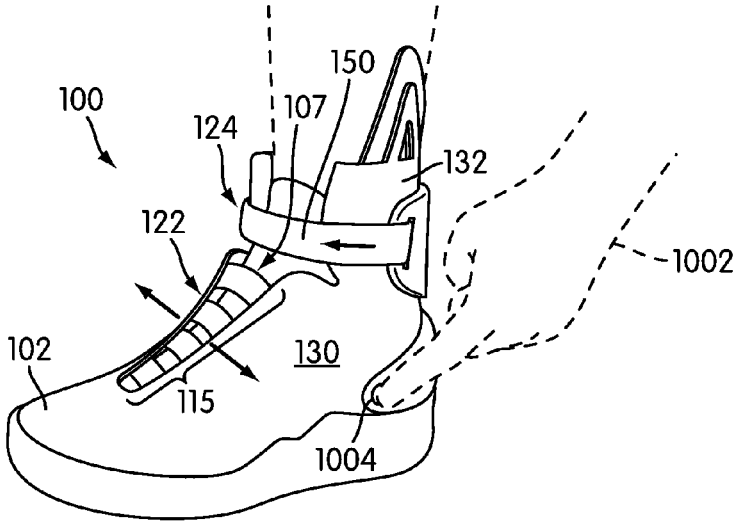
FIG. 10 is an isometric view of a preferred embodiment of an article of footwear automatically opening.

FIG. 10 illustrates an exemplary embodiment of automatic lacing system 122 and automatic ankle cinching system 124 moving to an open position. In the current embodiment, user 1002 may depress button 1004 to indicate that upper 102 should be loosened. It should be understood that this embodiment is only intended to be exemplary, and in other embodiments another type of button, lever, as well as other input mechanisms may be used to open automatic lacing system 122 and automatic ankle cinching system 124.

As seen in FIG. 10, automatic lacing system 122 has been controlled to loosen strap set 115 at arch portion 130. In some embodiments, automatic ankle cinching system 124 may also be configured to automatically loosen ankle strap 150 at ankle portion 132. In a preferred embodiment, ankle strap 150 may be manually loosened by a wearer. For example, in some cases, a wearer may pull on ankle strap 150 to adjust ankle strap to an open, or loosened, position. With this arrangement, upper 102 may be loosened around a foot and an ankle to allow a user to easily remove article of footwear 100.

Figure 11:
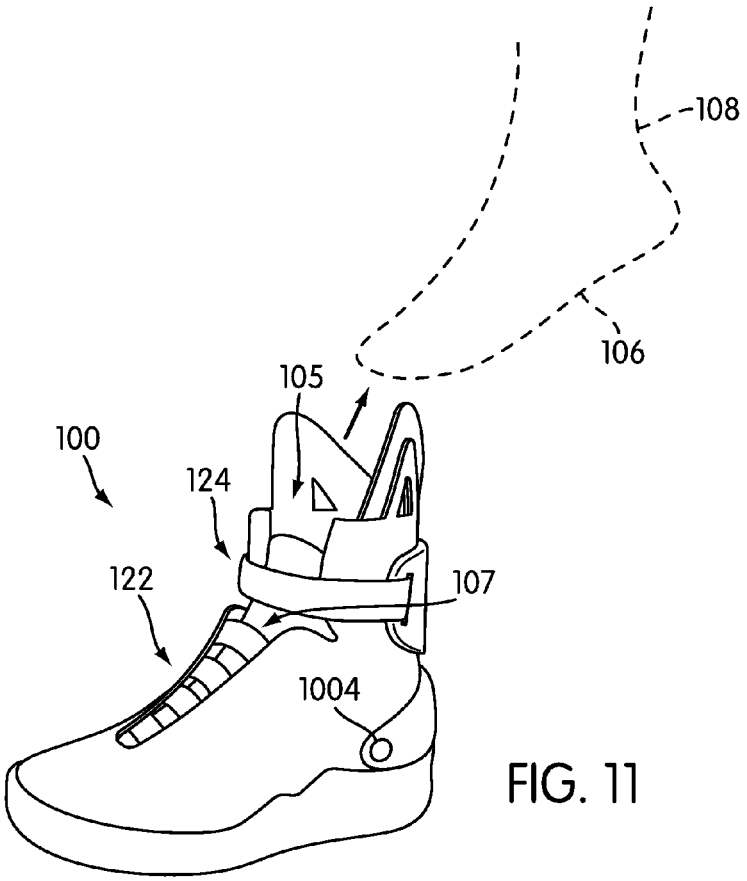
FIG. 11 is an isometric view of a preferred embodiment of an article of footwear in an open position.

FIG. 11 illustrates an exemplary embodiment of article 100 in a fully loosened, or open, position. In particular, automatic lacing system 122 is in a fully open position that provides for a widened lacing gap 107. Likewise, automatic ankle cinching system 124 is in a fully open position that provides for a widened entry hole 105. With upper 102 fully loosened, foot 106 and ankle 108 can be completely removed from upper 102.

In the current embodiment, automatic lacing system 122 and automatic ankle cinching system 124 are configured to open and close approximately simultaneously. However, it should be understood that in other embodiments, automatic lacing system 122 and automatic ankle cinching system 124 could be operated independently. For example, in one alternative embodiment, automatic lacing system 122 could be opened and/or closed prior to the opening and/or closing of automatic ankle cinching system 124.

FIGS. 12-26 are intended to illustrate in detail the individual components and operation of both automatic lacing system 122 and automatic ankle cinching system 124. It should be understood that the following detailed description discusses a preferred embodiment for automatic lacing system 122 and automatic ankle cinching system 124. In other embodiments, some provisions or components of these systems could be optional. Furthermore, in other embodiments, additional provisions or components could be provided to these systems.

Figure 12:
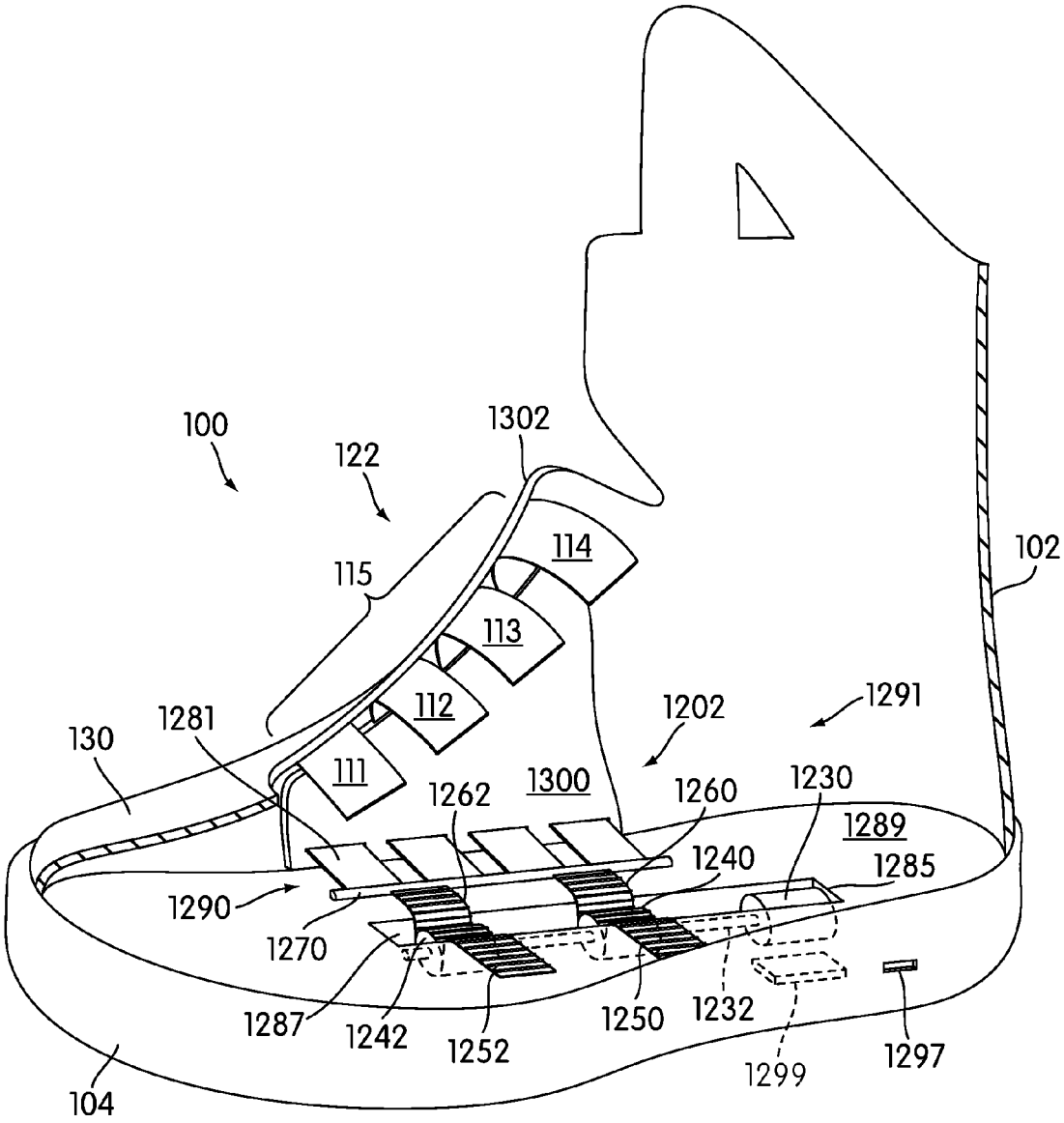
FIG. 12 is a side cross sectional view of a preferred embodiment of an article of footwear including an automatic lacing system.
Figure 13:
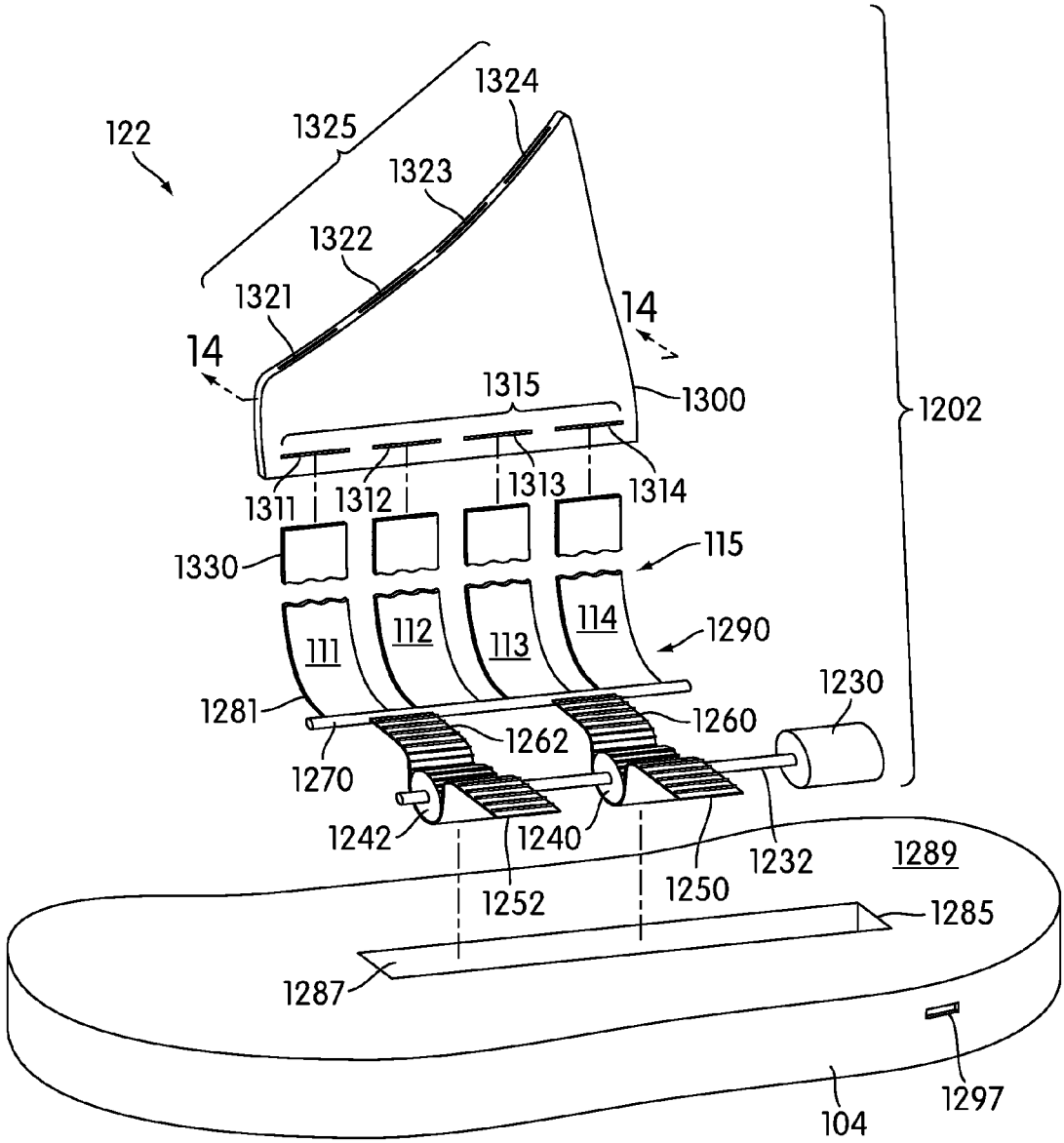
FIG. 13 is an exploded isometric view of a preferred embodiment of an automatic lacing system.

FIGS. 12 and 13 illustrate an assembled isometric view and an exploded isometric view, respectively, of automatic lacing system 122. For purposes of clarity, a portion of upper 102 has been cut away in FIG. 12.

As previously discussed, automatic lacing system 122 preferably includes strap set 115. Preferably, automatic lacing system 122 also includes provisions for moving strap set 115. In this embodiment, automatic lacing system 122 preferably includes strap moving mechanism 1202. The term "strap moving mechanism" as used throughout this detailed description and in the claims refers to any mechanism capable of providing motion to one or more straps without requiring work to be performed by the user.

Preferably, strap moving mechanism 1202 includes provisions for powering automatic lacing system 122. Generally, any type of power source can be utilized. Various types of power sources include, but are not limited to, electrical power sources, mechanical power sources, chemical power sources, as well as other types of power sources. In some embodiments, strap moving mechanism 1202 includes motor 1230. Motor 1230 could be any type of motor, including, but not limited to, an electric motor, an electrostatic motor, a pneumatic motor, a hydraulic motor, a fuel powered motor or any other type of motor. In this preferred embodiment, motor 1230 is an electric motor that transforms electrical energy into mechanical energy.

Generally, motor 1230 may be associated with an electrical power source of some kind. In some cases, motor 1230 could be associated with an external battery. In still other cases, motor 1230 could include an internal battery. In this preferred embodiment, motor 1230 may be configured to receive power from internal battery 1299. Battery 1299 could be any type of battery. In some embodiments, battery 1299 could be a disposable battery. Examples of different types of disposable batteries include, but are not limited to, zinc-carbon, zinc-chloride, alkaline, silver-oxide, lithium disulfide, lithium-thionyl chloride, mercury, zinc-air, thermal, water-activated, nickel oxyhydroxide, and paper batteries. In a preferred embodiment, battery 1299 could be a rechargeable battery of some kind. Examples of rechargeable batteries include, but are not limited to nickel-cadmium, nickel-metal hydride and rechargeable alkaline batteries.

Generally, battery 1299 could be disposed in any portion of article 100. In some embodiments, battery 1299 could be associated with an ankle cuff of article 100. In other embodiments, battery 1299 could be disposed in another portion of upper 102. In a preferred embodiment, battery 1299 may be disposed in a portion of sole 104. This arrangement preferably helps to protect battery 1299 from the elements and direct contact with a foot of the wearer.

Generally, the size of battery 1299 may vary. In some embodiments, battery 1299 could have a length in the range of 10 mm to 50 mm. Furthermore, battery 1299 could have a width in the range of 10 mm to 50 mm. In a preferred embodiment, battery 1299 has a width of about 30 mm. Furthermore, battery 1299 preferably has a length of about 40 mm.

In some embodiments, article 100 may include provisions for recharging battery. In some cases, an inductive charger may be used. In other cases, a USB-based charger may be used. In still other cases, other types of charging provisions can be used. In this preferred embodiment, sole 104 includes charging port 1297. In this embodiment, charging port 1297 may be a mini-USB type charging port. Furthermore, charging port 1297 may be electrically connected with battery 1299 via an electrical circuit of some kind. Preferably, charging port 1297 can be coupled to a battery charger of some kind. With this arrangement, power can be transferred to battery 1299 from an external power source in order to recharge battery 1299.

Motor 1230 may be connected to driveshaft 1232. In particular, motor 1230 is preferably configured to provide torque to driveshaft 1232 to rotate driveshaft 1232. Furthermore, driveshaft 1232 may include one or more gears for transferring power to strap set 115. In this preferred embodiment, driveshaft 1232 may include first gear 1240 and second gear 1242.

In some embodiments, strap moving mechanism 1202 may include one or more belts for transferring power to strap set 115. In this embodiment, strap moving mechanism 1202 may include first belt 1250 and second belt 1252. Preferably, first belt 1250 and second belt 1252 are configured to engage with first gear 1240 and second gear 1242, respectively. In a preferred embodiment, first belt 1250 and second belt 1252 are serpentine belts that move laterally with respect to sole 104 as first gear 1240 and second gear 1242 are rotated.

In some embodiments, first belt 1250 and second belt 1252 may be attached to a yoke member that is associated with strap set 115. In this embodiment, first attachment portion 1260 of first belt 1250 may be attached directly to yoke member 1270. Also, second attachment portion 1262 of second belt 1252 may be attached directly to yoke member 1270.

Preferably, each strap of strap set 115 is also directly attached to yoke member 1270. In this embodiment, first end portion 1281 of first strap 111 is attached to yoke member 1270. Likewise second strap 112, third strap 113 and fourth strap 114 are preferably attached to yoke member 1270 at similar end portions. This arrangement provides for a yoking configuration of first strap 111, second strap 112, third strap 113 and fourth strap 114. With this arrangement, first strap 111, second strap 112, third strap 113 and fourth strap 114 may move substantially in unison at first end portion 1290 of strap set 115. This preferably allows the tightening and loosening of upper 102 to be applied evenly over arch portion 130 of upper 102.

Generally, yoke member 1270 could be any type of yoke. In some embodiments, yoke member 1270 could be a curved yoke. For example, in some cases yoke member 1270 could be a bow yoke. In other embodiments, yoke member 1270 may be substantially straight. In this preferred embodiment, yoke member 1270 has an approximately cylindrical bar or rod shape. With this arrangement, multiple straps may be connected along the entirety of the length of yoke member 1270 in a generally parallel manner.

Preferably, article 100 includes provisions for receiving one or more components of strap moving mechanism 1202. In some embodiments, one or more components of strap moving mechanism 1202 may be disposed within upper 102. In other embodiments, one or more components of strap moving mechanism 1202 may be disposed within sole 104. In this preferred embodiment, sole 104 may include an interior cavity that is configured to receive multiple components of strap moving mechanism 1202.

Referring to FIGS. 12 and 13, sole 104 preferably includes interior cavity 1285. Generally, interior cavity 1285 may have any shape. Examples of different shapes include, but are not limited to, circular shapes, oval shapes, square shapes, rectangular shapes, polygonal shapes, regular shapes, irregular shapes as well as other kinds of shapes. In this exemplary embodiment, interior cavity 1285 has a generally rectangular shape.

Interior cavity 1285 is preferably configured to receive motor 1230. Additionally, interior cavity 1285 may be configured to receive driveshaft 1232, including first gear 1240 and second gear 1242. In particular, interior cavity 1285 may provide room for rotation of driveshaft 1232, first gear 1240 and second gear 1242.

In some embodiments, interior cavity 1285 may be disposed internally within sole 104. In other words, interior cavity 1285 may be disposed below an upper surface of sole 104. In other embodiments, interior cavity 1285 may be open at the upper surface of sole 104. In other words, interior cavity 1285 may be in fluid communication with an interior portion of upper 102.

In the current embodiment, interior cavity 1285 includes upper opening 1287 that is disposed on upper surface 1289 of sole 104. In other words, interior cavity 1285 is a recessed portion of upper surface 1289. In some embodiments, upper surface 1289 of sole 104 may be covered by an insole to separate interior cavity 1285 from foot receiving cavity 1291 of upper 102. With this arrangement, a foot may be prevented from contacting, and potentially interfering with, one or more components of strap moving mechanism 1202 that may be disposed within interior cavity 1285.

Preferably, automatic lacing system 122 also includes provisions for guiding strap set 115 within upper 102. In this embodiment, automatic lacing system 122 may include rigid hollow plate 1300. In this embodiment, rigid hollow plate 1300 may be associated with first sidewall portion 1302 of upper 102. In some embodiments, rigid hollow plate 1300 may be disposed against an inner surface of first sidewall portion 1302. In other embodiments, rigid hollow plate 1300 may be disposed against an outer surface of first sidewall portion 1302. In a preferred embodiment, rigid hollow plate 1300 may be integral with first sidewall portion 1302. In other words, rigid hollow plate 1300 may be disposed between an inner lining and an outer lining of upper 102 to provide rigid support at first sidewall portion 1302.

Referring to FIG. 13, rigid hollow plate 1300 may include holes for receiving straps into, and releasing straps from, a hollow cavity of rigid hollow plate 1300. In this embodiment, rigid hollow plate 1300 includes first lower hole 1311, second lower hole 1312, third lower hole 1313 and fourth lower hole 1314, referred to collectively as lower hole set 1315. Additionally, rigid hollow plate 1300 may include first upper hole 1321, second upper hole 1322, third upper hole 1323 and fourth upper hole 1324, referred to collectively as upper hole set 1325.

As illustrated in FIG. 13, second end portion 1330 of first strap 111 may be inserted into rigid hollow plate 1300 at first lower hole 1311 and may exit from rigid hollow plate 1300 at first upper hole 1321. Preferably, second portions of second strap 112, third strap 113 and fourth strap 114 may be similarly inserted into second lower hole 1312, third lower hole 1313 and fourth lower hole 1314, respectively. Likewise, second end portions of second strap 112, third strap 113 and fourth strap 114 may exit from rigid hollow plate 1300 at second upper hole 1322, third upper hole 1323 and fourth upper hole 1324, respectively. With this arrangement, rigid hollow plate 1300 may serve as a guide for strap set 115. Preferably, rigid hollow plate 1300 helps reduce friction between the straps of strap set 115 and upper 102 that might otherwise inhibit motion of the straps.

Generally, rigid hollow plate 1300 could have any shape. In some embodiments, rigid hollow plate 1300 may be generally flat. In other embodiments, rigid hollow plate 1300 could be curved. In a preferred embodiment, rigid hollow plate 1300 could have a curved shape that substantially matches the contours of first sidewall portion 1302. Furthermore, rigid hollow plate 1300 preferably extends from sole 104 to the top of first sidewall portion 1302. With this arrangement, rigid hollow plate 1300 may help guide strap set 115 through the interior of upper 102.

Generally, rigid hollow plate 1300 could have any thickness. In some embodiments, rigid hollow plate 1300 could have a thickness much greater than the lining of upper 102. In other embodiments, rigid hollow plate 1300 could have a thickness that is substantially less than the lining of upper 102. In this preferred embodiment, rigid hollow plate 1300 has a thickness that is substantially similar to the thickness of the lining of upper 102. With this arrangement, rigid hollow plate 1300 preferably does not substantially interfere with the motion and flexibility of upper 102 at first sidewall portion 1302.

A rigid hollow plate may be made of any substantially rigid material. Preferably, a rigid hollow plate is made of a material that is substantially more rigid than the upper. Examples of various materials that could be used to make a rigid hollow plate include, but are not limited to, plastic, rigid rubber, metal and wood, as well as other materials. In the preferred embodiment, rigid hollow plate 1300 is made of a substantially rigid plastic.

Figure 14:
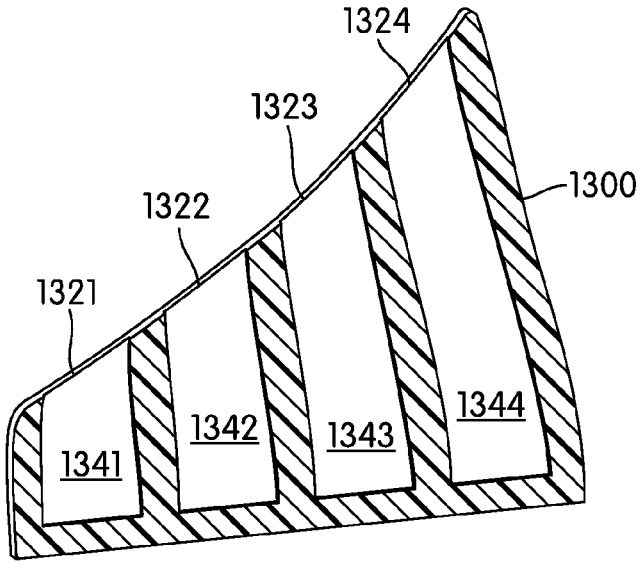
FIG. 14 is a cross sectional view of a preferred embodiment of a rigid hollow plate.

FIG. 14 is a cross sectional view of a preferred embodiment of the interior of rigid hollow plate 1300. Referring to FIG. 14, rigid hollow plate 1300 may include individual channels for receiving each strap of strap set 115. In this embodiment, rigid hollow plate 1300 includes first strap receiving channel 1341, second strap receiving channel 1342, third strap receiving channel 1343 and fourth strap receiving channel 1344 that are configured to receive first strap 111, second strap 112, third strap 113 and fourth strap 114, respectively.

In some embodiments, the strap receiving channels could be much larger than the straps of strap set 115. In a preferred embodiment, the dimensions of first strap receiving channel 1341, second strap receiving channel 1342, third strap receiving channel 1343 and fourth strap receiving channel 1344 are substantially similar to the dimensions of the straps of strap set 115. With this arrangement, first strap receiving channel 1341, second strap receiving channel 1342, third strap receiving channel 1343 and fourth strap receiving channel 1344 may be configured as guides that allow for a smooth sliding movement of each strap through rigid hollow plate 1300 without allowing for unwanted bending, twisting or other modes of motion that may inhibit this smooth sliding movement. For example, if the strap receiving channels are too large, the strap may bunch or fold within the strap receiving channel rather than slide through the strap receiving channel smoothly.

Generally, rigid hollow plate 1300 could have channels of any shape. In the current embodiment, first strap receiving channel 1341, second strap receiving channel 1342, third strap receiving channel 1343 and fourth strap receiving channel 1344 have a slightly curved shape since rigid hollow plate 1300 has an approximately curved shape. However, in other embodiments, the channels of a rigid hollow plate could also be approximately straight.

Figure 15:
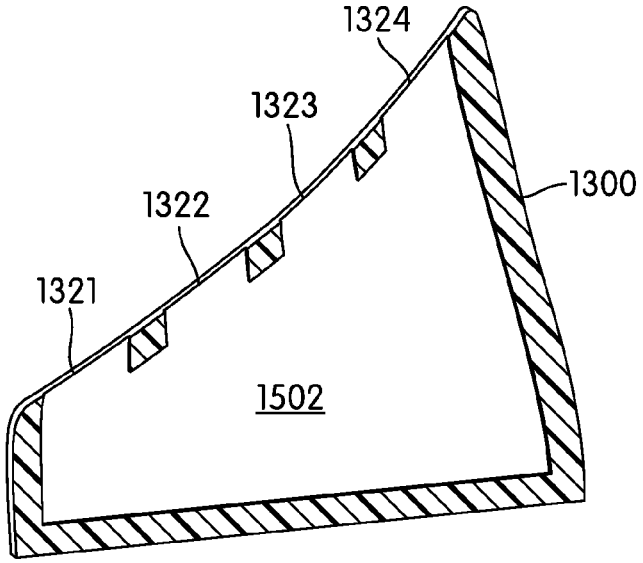
FIG. 15 is a cross sectional view of an alternative embodiment of a rigid hollow plate.

FIG. 15 illustrates an alternative embodiment of rigid hollow plate 1300. In this alternative embodiment, rigid hollow plate 1300 includes central hollow cavity 1502 for receiving each of the straps within strap set 115. Preferably, central hollow cavity 1502 has a thickness that is substantially equal to the thicknesses of each of the straps in strap set 115. This arrangement preferably allows movement of each strap in strap set 115 through central hollow cavity 1502 without allowing for folding, bunching or twisting of each strap in strap set 115.

Although the current embodiment includes a rigid hollow plate to help guide the straps of an automatic lacing system, in other embodiments, different provisions could be provided. Generally, any provision for reducing friction between a set of straps and a sidewall portion could be used. In another embodiment, for example, the lining of an upper could be rigid enough to substantially reduce friction between a set of straps and a sidewall portion. Furthermore, the lining of an upper could include channels that are configured to receive a set of straps and help guide the straps. In still another embodiment, the lining of an upper could be coated to present a substantially low friction surface to a set of straps. In still another embodiment, a low friction fabric could be used to make the lining of an upper. In still another embodiment, one or more flexible tubes could be configured to receive a set of straps from within the upper and help guide the set of straps through the upper.

Figure 16:
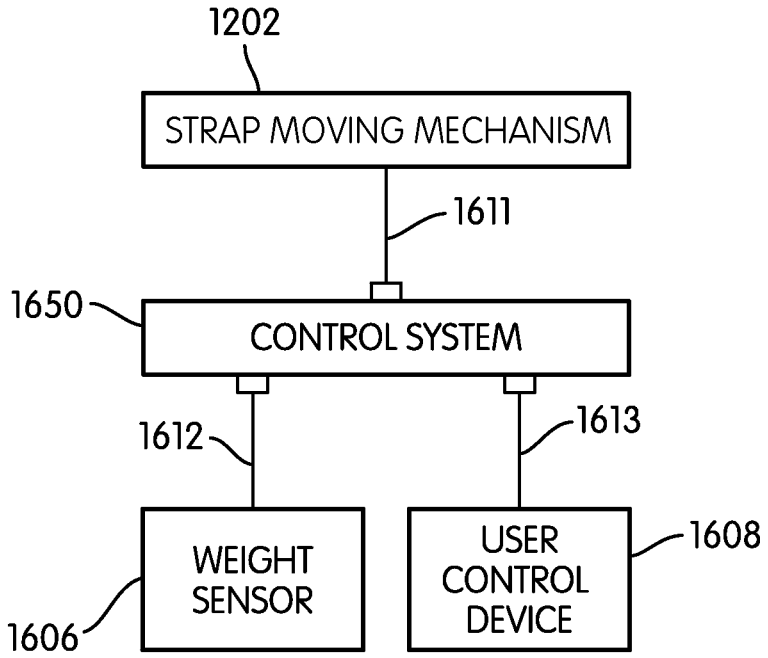
FIG. 16 is a schematic view of a preferred embodiment of optional inputs to a strap moving mechanism.

Referring to FIG. 16, automatic lacing system 122 may include one or more provisions for controlling strap moving mechanism 1202. In particular, automatic lacing system 122 could be associated with one or more control systems, sensors, user operated devices or other provisions. It should be understood that each of the following provisions are intended to be exemplary and in some embodiments some provisions could be optional.

As previously discussed, automatic lacing system 122 preferably includes provisions for activating a strap moving mechanism to open or close a set of straps. In some embodiments, strap moving mechanism 1202 may be provided with a control system of some kind. The term "control system" as used throughout this detailed description and in the claims refers to any type of device for determining an operating state of a strap moving mechanism. For example, in some embodiments, a control system could be a central processing unit (CPU) of some kind. In other embodiments, a control system could be a simple circuit of some kind for receiving electrical inputs and providing an electrical output according to the inputs. In this preferred embodiment, automatic lacing system 122 preferably includes control system 1650 that is connected to strap moving mechanism 1202 via first connection 1611.

Figure 17:
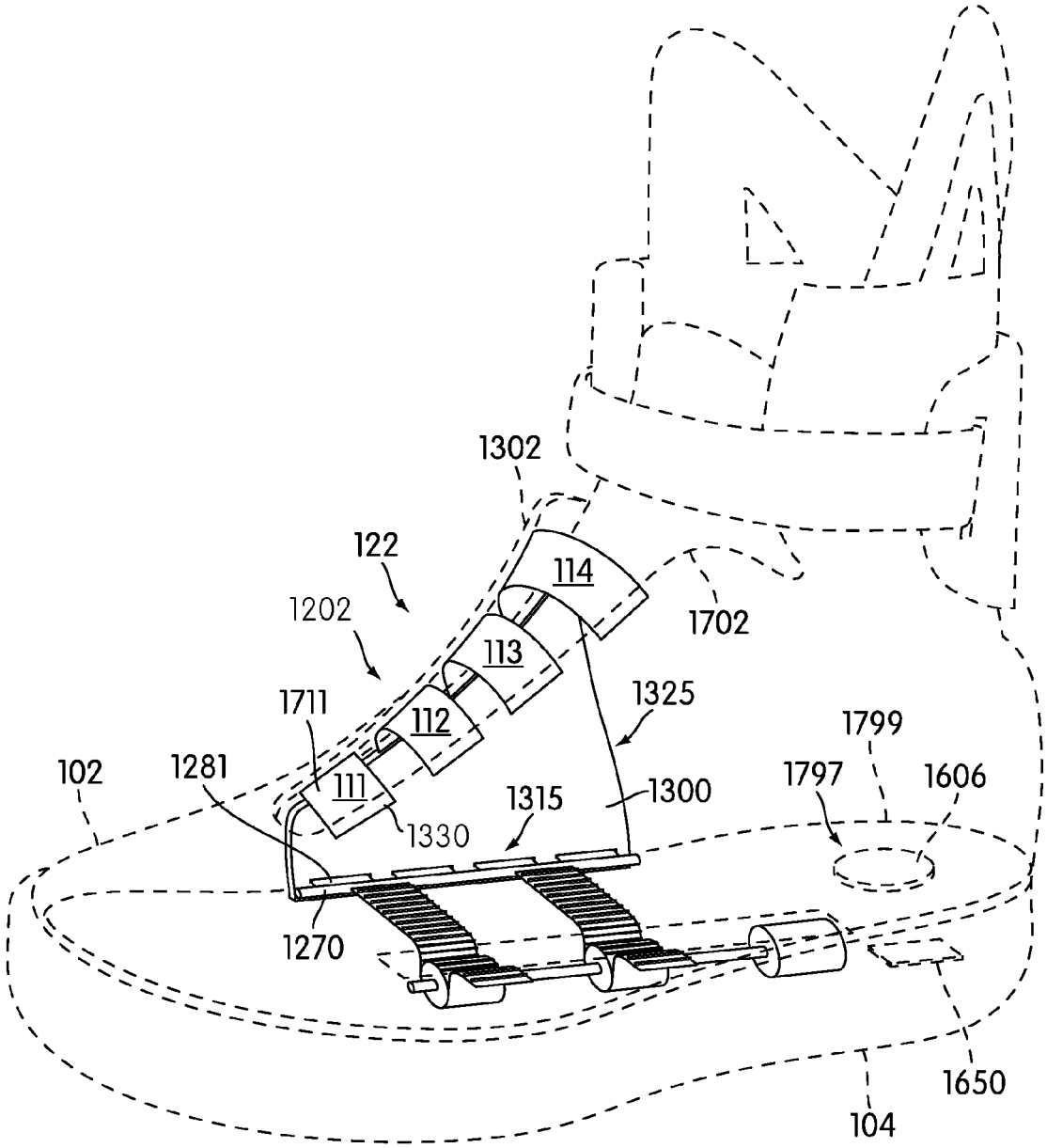
FIG. 17 is an isometric view of a preferred embodiment of an automatic lacing system in an open position.

Generally, control system 1650 may be disposed in any portion of article 100. In some embodiments, control system 1650 could be disposed in a portion of upper 102. In a preferred embodiment, control system 1650 could be disposed in sole 104. Referring to FIG. 17, control system 1650 may be associated with sole 104. In particular, control system 1650 may be disposed within a heel portion of sole 104.

Generally, control system 1650 may have any size. In some embodiments, control system 1650 may have a length in the range between 10 mm and 50 mm. Likewise, control system 1650 may have a length in the range between 10 mm and 50 mm. In a preferred embodiment, control system 1650 may have a length of about 40 mm. Also, control system 1650 may have a width of about 30 mm. In still another embodiment, control system 1650 could have a length of about 25 mm. Also, control system 1650 could have a width of about 25 mm.

Referring back to FIG. 16, automatic lacing system 122 may include one or more sensors that can be used to determine when automatic lacing system 122 should tighten or loosen upper 102. Examples of different types of sensors that may be used include, but are not limited to, weight sensors, light sensors, audio sensors, heat sensors, as well as other types of sensors. In this embodiment, automatic lacing system 122 may be provided with weight sensor 1606. In some cases, weight sensor 1606 may be connected directly to strap moving mechanism 1202. In a preferred embodiment, weight sensor 1606 may be connected to control system 1650 via second connection 1612. With this arrangement, control system 1650 may receive signals from weight sensor 1606 to determine if strap moving mechanism 1202 should be activated.

Generally, weight sensor 1606 could be located in any portion of article 100. In some embodiments, weight sensor 1606 could be located in a portion of sole 104. In a preferred embodiment, weight sensor 1606 could be located in an insole or sock liner of article 100. In still other embodiments, weight sensor 1606 could be located in other portions of article 100.

Referring to FIG. 17, article 100 may include sock liner 1799 in some embodiments. Generally, sock liner 1799 could be any type of insole or liner. In some cases, sock liner 1799 could be a removable liner. In other embodiments, sock liner 1799 could be permanently attached to sole 104.

Preferably, weight sensor 1606 may be disposed in heel portion 1797 of sock liner 1799. With this arrangement, as a foot is inserted into upper 102 and pressed against heel portion 1797, a signal may be sent to control system 1650 to activate strap moving mechanism 1202. At this point, control system 1650 may send a signal to activate strap moving mechanism 1202 in order to tighten upper 102 by moving strap set 115.

In some embodiments, control system 1650 can be configured to automatically activate strap moving mechanism 1202 following a signal from weight sensor 1606. In other embodiments, however, control system 1650 can be configured with a time delay upon receiving a signal from weight sensor 1606. With this arrangement, strap moving mechanism 1202 may not be activated until some time has passed in order to allow a user to completely insert his or her foot.

It should be understood that additional sensors can be used in addition to a weight sensor. In some embodiments, a sensor may be used to provide information related to the tightness of a strap set. In some cases, the sensor can be applied to a portion of the strap set to determine if the strap set is tightened properly. In other cases, the sensor can be applied at the motor. By measuring the torque or force needed by the motor to continue moving the straps of the strap set, the proper degree of tightness can be determined.

Referring back to FIG. 16, strap moving mechanism 1202 may be provided with a user controlled device of some kind. The term "user controlled device" refers to any device that is configured to receive input directly from a user. In this embodiment, control system 1650 is preferably connected to user control device 1608 via third connection 1613. Upon receiving a signal from user control device 1608, control system 1650 may then activate strap moving mechanism 1202. An example of a user controlled device includes a button that can be pushed to activate strap moving mechanism 1202, as illustrated in FIG. 10. However, in other embodiments, any type of user controlled device could be used, including, but not limited to, levers, switches, dials, consoles or other user controlled devices.

Generally, first connection 1611, second connection 1612 and third connection 1613 may be any type of connection that is configured to transfer information and/or energy. In some embodiments, wired connections may be used. In other embodiments, wireless connections may be used.

FIGS. 17 through 21 illustrate a preferred embodiment of the operation of automatic lacing system 122. For purposes of clarity, upper 102 and sole 104 are indicated here in phantom. Referring to FIG. 17, automatic lacing system 122 is in an open or loosened condition. As previously discussed, first strap 111 preferably includes first end portion 1281 that is attached to yoke member 1270 near first sidewall portion 1302. Likewise, first strap 111 includes second end portion 1330 that is attached to second sidewall portion 1702 of upper 102. Also, first strap 111 may include intermediate portion 1711 that is disposed between first end portion 1281 and second end portion 1330.

Preferably, second strap 112, third strap 113 and fourth strap 114 are arranged in a similar manner to first strap 111. In particular, each strap of strap set 115 preferably includes a first portion attached to yoke member 1270 and a second portion attached to second sidewall portion 1702. Additionally, each strap set 115 preferably includes an intermediate portion that is disposed between the first end portion and the second end portion of each strap.

With automatic lacing system 122 in this open position, yoke member 1270 is preferably disposed adjacent to lower hole set 1315. In other words, strap set 115 is maximally extended from upper hole set 1325. Also, intermediate portion 1711 may be disposed outside of rigid hollow plate 1300. In this open position, further extension, or loosening, of strap set 115 cannot be achieved because yoke member 1270 prevents further extension of strap set 115 from upper hole set 1325.

Figure 18:
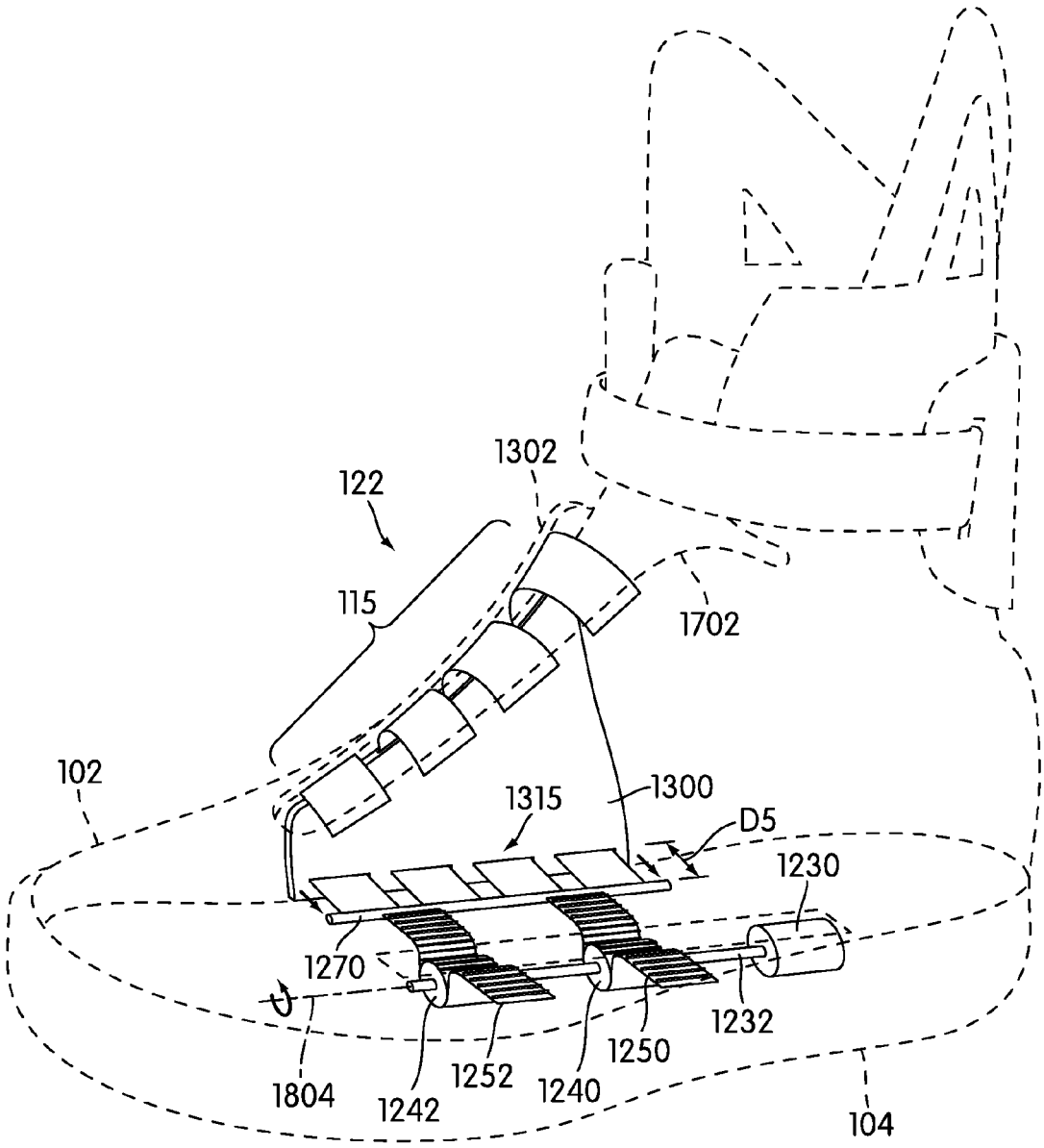
FIG. 18 is an isometric view of a preferred embodiment of an automatic lacing system tightening.

Referring to FIG. 18, automatic lacing system 122 has been activated. In the current embodiment, motor 1230 may receive a signal from control system 1650 disposed within sole 104 (see FIG. 17). In particular, motor 1230 could receive a signal from control system 1650 that weight sensor 1606 has been activated. At this point, motor 1230 is activated and begins to rotate driveshaft 1232 in a counterclockwise direction with respect to longitudinal axis 1804. As driveshaft 1232 rotates, first gear 1240 and second gear 1242 also rotate in the counterclockwise direction. Preferably, first gear 1240 and second gear 1242 are engaged with first belt 1250 and second belt 1252, respectively. In particular, first gear 1240 and second gear 1242 preferably include teeth that mesh with teeth on first belt 1250 and second belt 1252. With this arrangement, as first gear 1240 and second gear 1242 rotate counterclockwise, first belt 1250 and second belt 1252 are moved laterally, with respect to sole 104, towards second sidewall portion 1702.

Since first belt 1250 and second belt 1252 are fastened to yoke member 1270, this lateral movement places tension on yoke member 1270 and pulls yoke member 1270 away from lower hole set 1315 of rigid hollow plate 1300 by a distance D5. Furthermore, as yoke member 1270 is pulled away from lower hole set 1315, strap set 115 is pulled down through rigid hollow plate 1300. This motion preferably tightens strap set 115 and pulls second sidewall portion 1702 towards first sidewall portion 1302 of upper 102.

Figure 19:
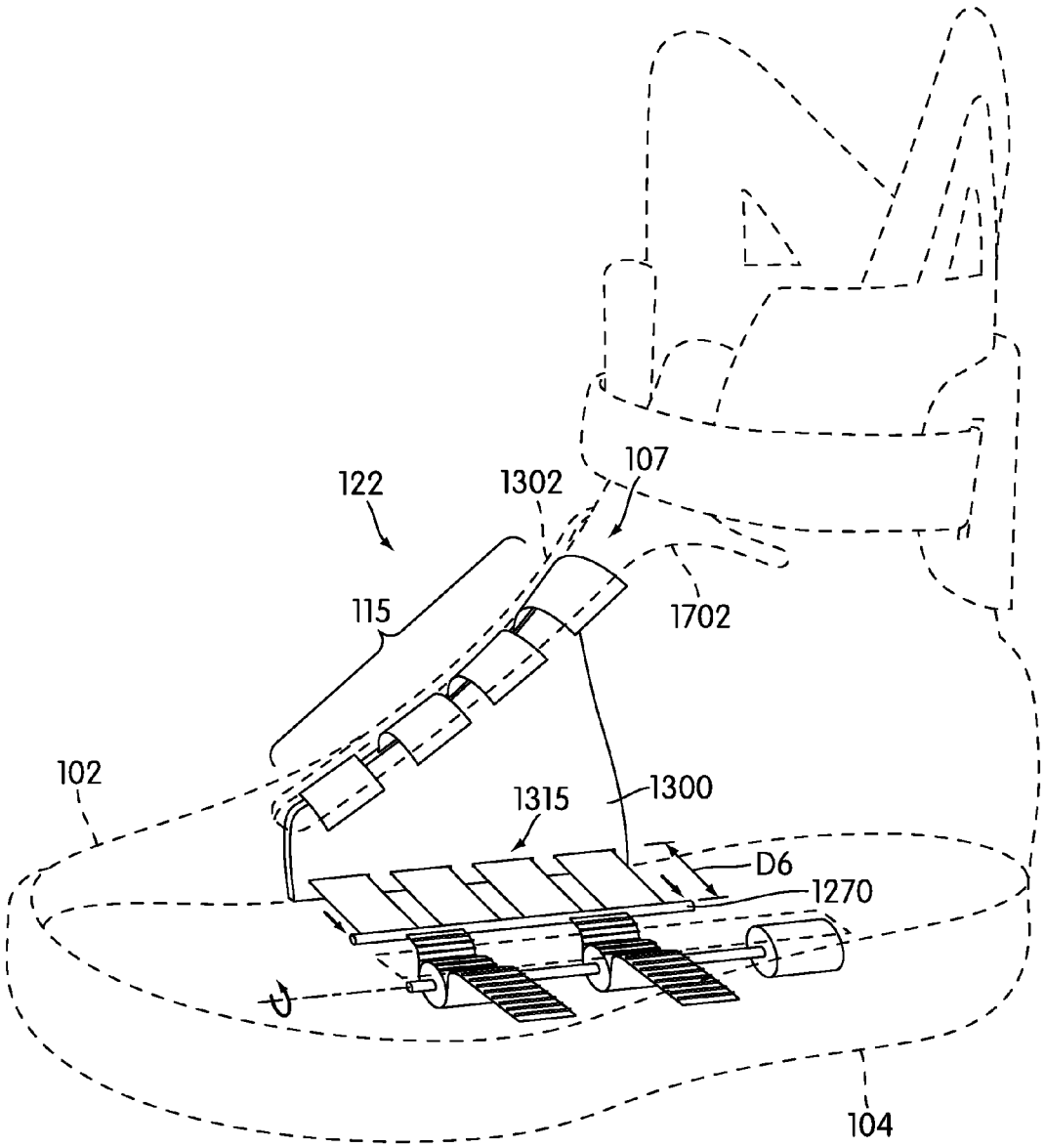
FIG. 19 is an isometric view of a preferred embodiment of an automatic lacing system in a closed position.

Referring to FIG. 19, automatic lacing system 122 is in a fully closed, or tightened, position. In this closed position, yoke member 1270 has extended further away from lower hole set 1315 by a distance D6 that is substantially larger than distance D5. Furthermore, strap set 115 has been pulled taut over lacing gap 107 of upper 102. Preferably, in this closed position, upper 102 is fully tightened around a foot.

Figure 20:
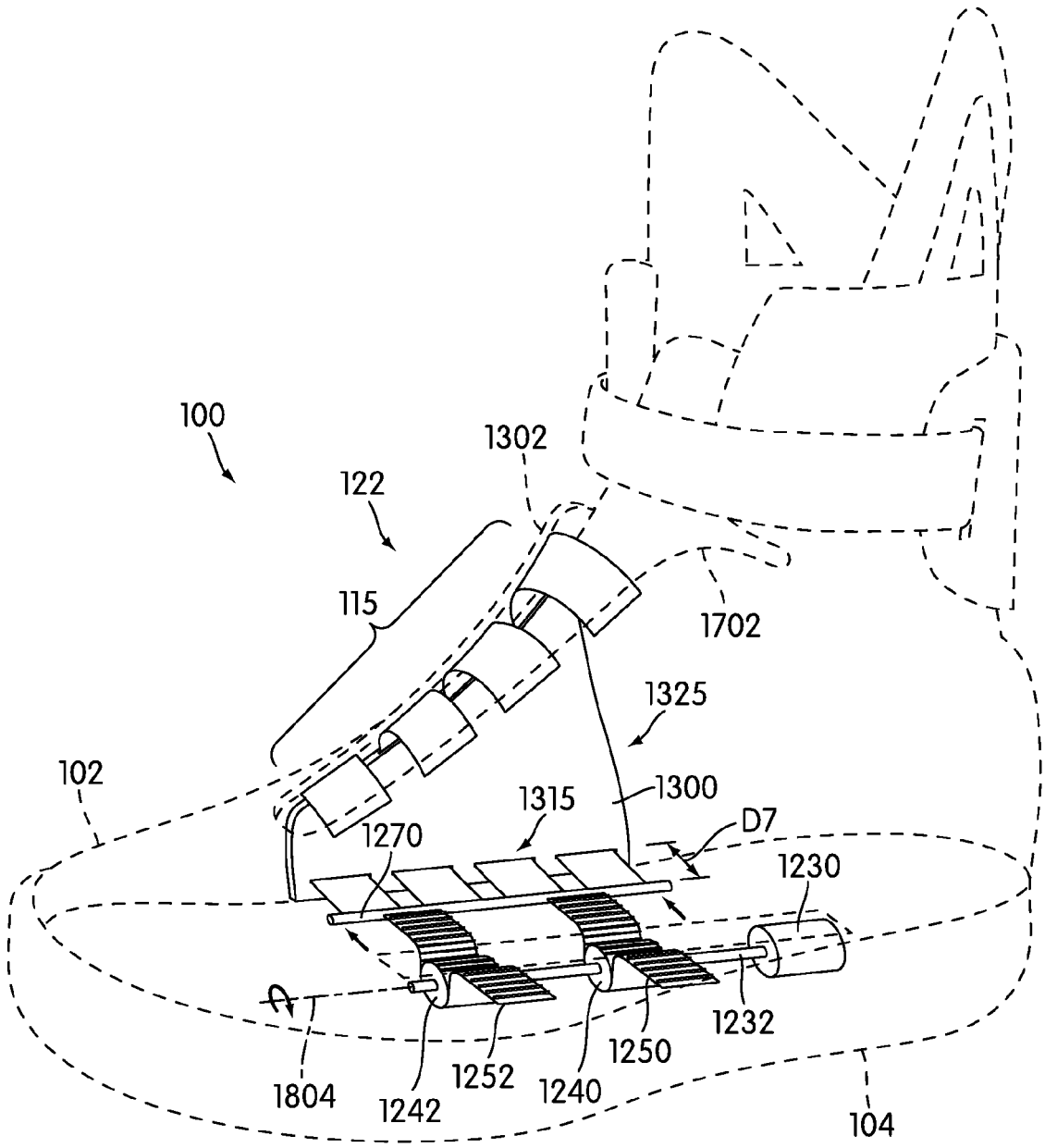
FIG. 20 is an isometric view of a preferred embodiment of an automatic lacing system loosening.
Figure 21:
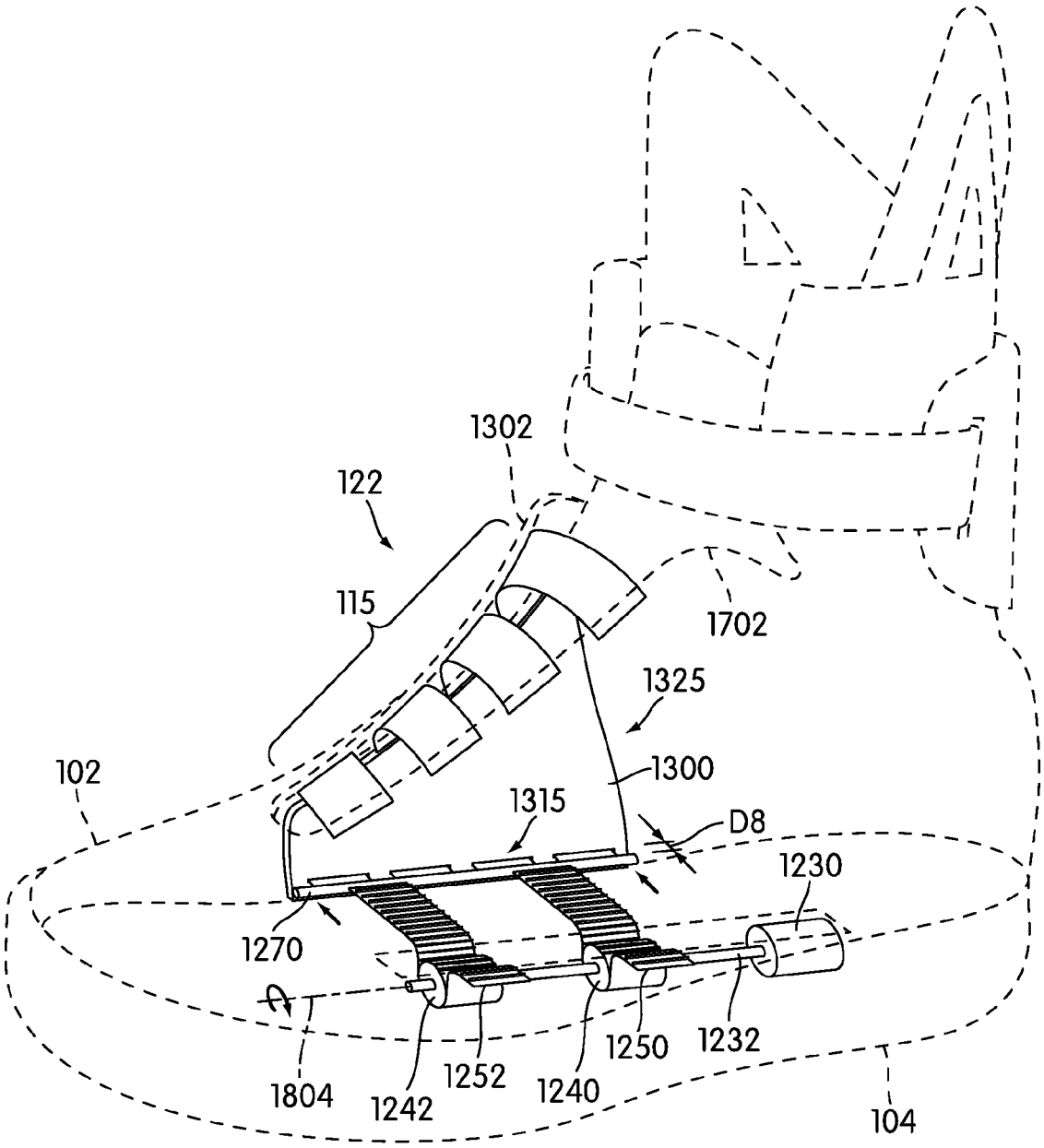
FIG. 21 is an isometric view of a preferred embodiment of an automatic lacing system loosening.

Referring to FIGS. 20 and 21, automatic lacing system 122 may be returned to an open position when a user is ready to remove article 100. In this embodiment, as previously discussed, a user may depress a button to open automatic lacing system 122 (see FIG. 10). Preferably, once the button is depressed, a signal is received at motor 1230 to open automatic lacing system 122.

To open automatic lacing system 122, motor 1230 may be operated in a reverse direction. In other words, in the current embodiment, motor 1230 may be configured to rotate in a clockwise direction with respect to longitudinal axis 1804. The clockwise rotation of motor 1230 causes driveshaft 1232, first gear 1240 and second gear 1242 to rotate in a clockwise direction as well. The clockwise rotation of first gear 1240 and second gear 1242 further moves first belt 1250 and second belt 1252, respectively, in a lateral direction towards first sidewall portion 1302. As first belt 1250 and second belt 1252 move towards first sidewall portion 1302, yoke member 1270 is pushed closer to lower hole set 1315 of rigid hollow plate 1300. Furthermore, strap set 115 is pushed through rigid hollow plate 1300 so that strap set 115 extends further out of upper hole set 1325. This motion generally loosens strap set 115 and allows for some increase in the spacing between first sidewall portion 1302 and second sidewall portion 1702.

As seen in FIGS. 20 and 21, the distance between yoke member 1270 and lower hole set 1315 decreases as automatic lacing system 122 is opened. At one point, seen in FIG. 20, yoke member 1270 and lower hole set 1315 are separated by a distance D7. Following this, at a later point in time seen in FIG. 21, yoke member 1270 and lower hole set 1315 are separated by a distance D8 that is substantially smaller than distance D7. Eventually, automatic lacing system 122 may be disposed in a fully opened position, as seen in FIG. 17. At this point, a foot may be removed from upper 102.

Figure 22:
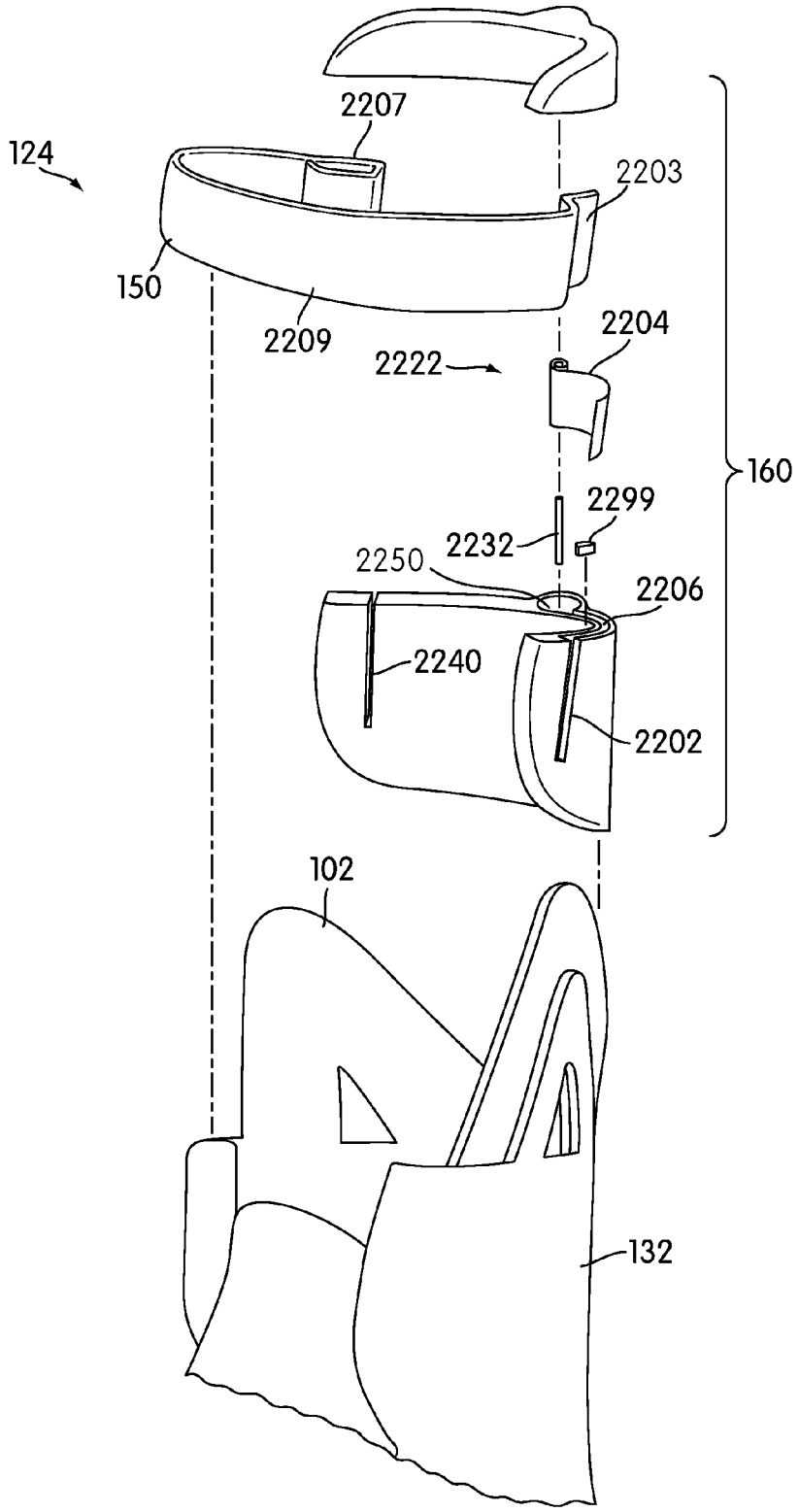
FIG. 22 is an exploded isometric view of a preferred embodiment of an automatic ankle cinching system.
Figure 23:
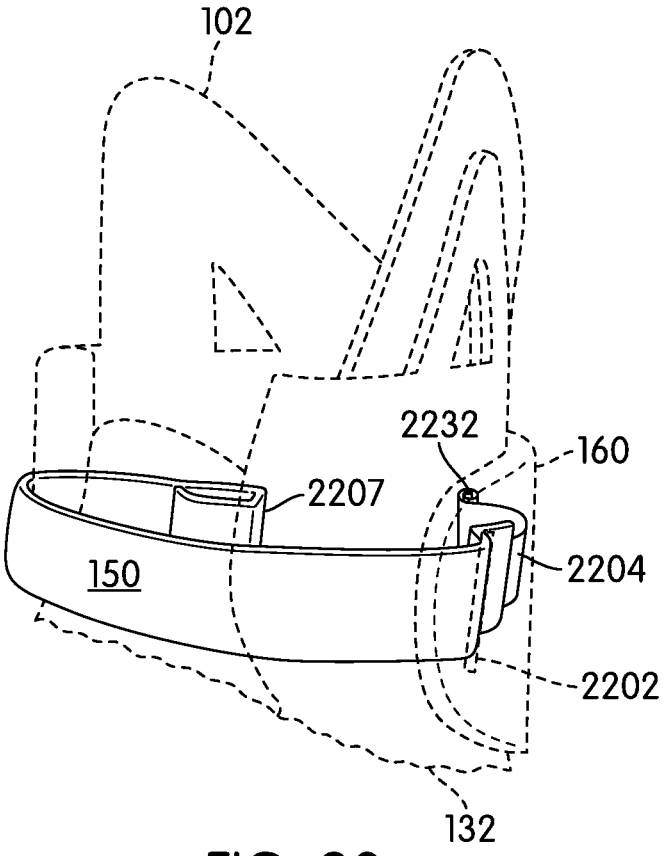
FIG. 23 is an isometric view of a preferred embodiment of an automatic ankle cinching system.

FIGS. 22 and 23 illustrate an exploded isometric view and an assembled view, respectively, of automatic ankle cinching system 124. As previously discussed, automatic ankle cinching system 124 includes ankle strap 150. Ankle strap cinching system 124 also preferably includes housing 160 that is configured to receive a portion of ankle strap 150. In some embodiments, housing 160 may include hollow channel 2206. Furthermore, housing 160 may include slot 2202 that provides an opening for hollow channel 2206 on an outer surface of housing 160. In a preferred embodiment, hollow channel 2206 and slot 2202 may be configured to receive first end portion 2203 of ankle strap 150. With this arrangement, first end portion 2203 of ankle strap 150 may be configured to slide within slot 2202 and hollow channel 2206.

Preferably, automatic ankle cinching system 124 also includes provisions for moving ankle strap 150. In this embodiment, automatic ankle cinching system 124 preferably includes strap moving mechanism 2222. As previously discussed, the term "strap moving mechanism" as used throughout this detailed description and in the claims refers to any mechanism capable of providing motion to the straps.

Preferably, strap moving mechanism 2222 includes coil spring 2204. In some embodiments, ankle strap 150 may be associated with coil spring 2204 at first end portion 2203. Preferably, coil spring 2204 is also connected to shaft 2232. With this arrangement, as coil spring 2204 unwinds around shaft 2232, a tension may be applied to first end portion 2203.

Preferably, housing 160 includes provisions for receiving the components of strap moving mechanism 2222. In some embodiments, housing 160 may include housing cavity 2250. In a preferred embodiment, housing cavity 2250 is shaped to receive coil spring 2204 as well as shaft 2232.

Although strap moving mechanism 2222 comprises coil spring 2204 and shaft 2232 in the current embodiment, in other embodiments strap moving mechanism 2222 could comprise additional components as well. For example, in some embodiments, shaft 2232 could be associated with a motor that is configured to rotate shaft 2232 to provide additional tension to ankle strap 150. Additionally, in other embodiments, shaft 2232 could be associated with other gears, belts or provisions for supplying power to, and moving, ankle strap 150.

Preferably, strap moving mechanism 2222 may be associated with provisions for locking ankle strap 150 into an open, or extended, position. In this preferred embodiment, strap moving mechanism 2222 includes locking mechanism 2299. For purposes of clarity, locking mechanism 2299 is shown schematically in the Figures.

Generally, locking mechanism 2299 may be associated with any portion of automatic ankle cinching system 124. In a preferred embodiment, locking mechanism may be associated with housing 160. With this arrangement, locking mechanism 2299 may be configured to interact with portions of ankle strap 150. In particular, locking mechanism 2299 may be configured to restrict the motion of ankle strap 150 in some situations.

Preferably, as ankle strap 150 is fully extended to an open position, locking mechanism 2299 engages a portion ankle strap 150 and prevents ankle strap 150 from sliding back into housing 160 under the tension of coil spring 2204. Generally, locking mechanism 2299 may include any provisions for engaging a portion of ankle strap 150. In some embodiments, locking mechanism 2299 may engage a mechanical tab or similar provision on ankle strap 150 that prevents retraction of ankle strap 150. In other embodiments, locking mechanism 2299 may include provisions for clamping or pinching first end portion 2203 when ankle strap 150 is fully extended.

Preferably, automatic ankle cinching system 124 includes provisions for releasing locking mechanism 2299. In some embodiments, locking mechanism 2299 may be released manually. For example, in some cases, a portion of locking mechanism 2299 could be depressed to release ankle strap 150. In a preferred embodiment, locking mechanism 2299 may be an electrically controlled mechanism. In particular, locking mechanism 2299 may be configured to release ankle strap 150 using an electrical signal of some kind.

Preferably, locking mechanism 2299 is in communication with one or more sensors and/or control systems. In a preferred embodiment, locking mechanism 2299 is in communication with control system 1650. Using this arrangement, control system 1650 may send a signal to disengage locking mechanism 2299 from ankle strap 150 when weight sensor 1606 has been activated. As locking mechanism 2299 releases, ankle strap 150 may be pulled tightly around an ankle under the tension of coil spring 2204.

Generally, second end portion 2207 of ankle strap 150 may be associated with any portion of ankle portion 132 of upper 102. In some embodiments, second end portion 2207 may be attached to housing 160. In other embodiments, second end portion 2207 could be attached directly to ankle portion 132 of upper 102. In a preferred embodiment, second end portion 2207 is fixedly attached to housing 160 at slot 2240. With this arrangement, second end portion 2207 may remain fixed in place while first end portion 2204 of ankle strap 150 may move to provide cinching around ankle portion 132.

As illustrated in FIG. 23, coil spring 2204 is preferably configured to wind around shaft 2232. Generally, shaft 2232 may be oriented in any direction. In some embodiments, shaft 2232 could be oriented in a generally horizontal direction. In a preferred embodiment, shaft 2232 may be oriented in a generally vertical direction. In other words, shaft 2232 may be oriented in a direction that is generally perpendicular with an upper surface of a sole of the article. With this arrangement, the orientation of ankle strap 150 can be maintained along the length of ankle strap 150 to prevent twisting.

As previously discussed, automatic ankle cinching system 124 may be operated simultaneously with automatic lacing system 122. In some embodiments, automatic ankle cinching system 124 may be in communication with automatic lacing system 122. As previously discussed, strap moving mechanism 2222 of automatic ankle cinching system 124 may be configured to close when strap moving mechanism 1202 of automatic lacing system 122 is closed. In other embodiments, automatic ankle cinching system 124 could be operated independently of automatic lacing system 122. In particular, strap moving mechanism 2222 of automatic ankle cinching system 124 could be associated with any of the optional inputs discussed with respect to strap moving mechanism 1202 of automatic lacing system 122. For example, strap moving mechanism 2222 could be associated with one or more sensors. Additionally, strap moving mechanism 2222 could be used with one or more user controlled devices.

Figure 26:
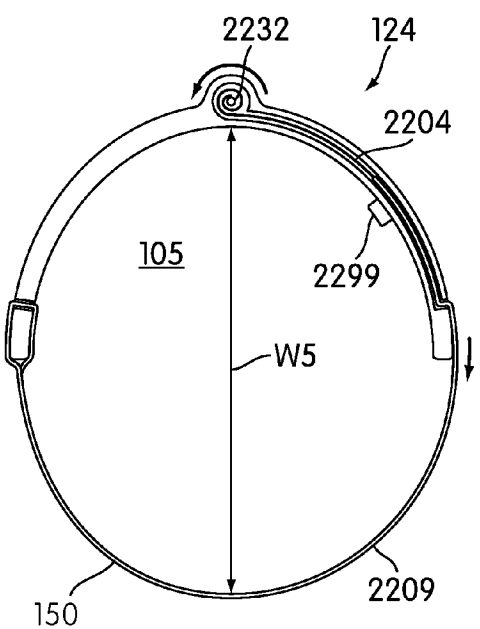
FIG. 26 is a top down view of a preferred embodiment of an automatic ankle cinching system in an open position.
Figure 25:
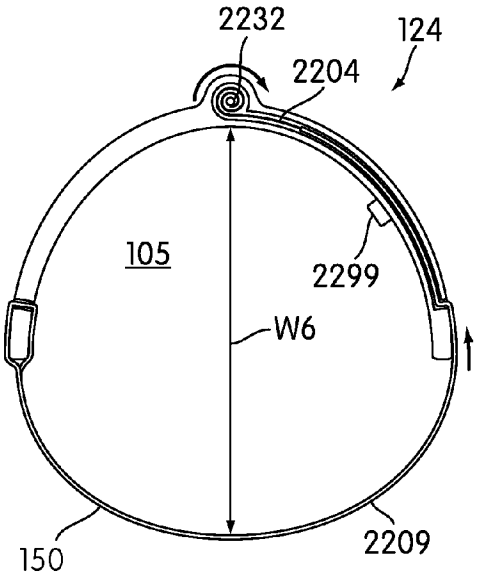
FIG. 25 is a top down view of a preferred embodiment of an automatic ankle cinching system in a closed position.
Figure 24:
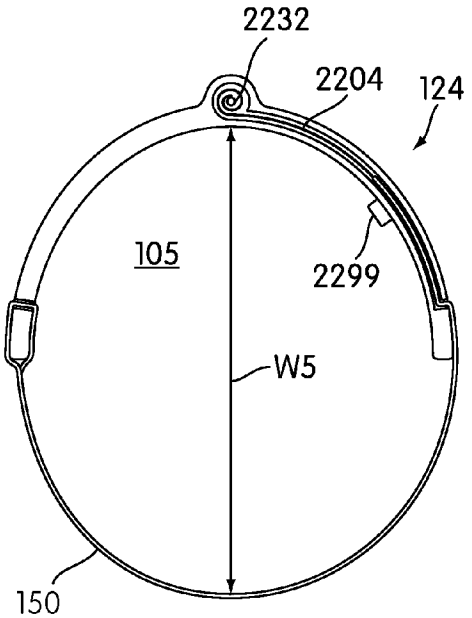
FIG. 24 is a top down view of a preferred embodiment of an automatic ankle cinching system in an open position.

FIGS. 24 through 26 illustrate a preferred embodiment of the operation of automatic ankle cinching system 124. For purposes of clarity, automatic ankle cinching system 124 is shown in isolation in these Figures. Referring to FIG. 24, automatic ankle cinching system 124 is disposed in an open position. In this open position, a foot may be easily inserted into entry hole 105. At this point, entry hole 105 may have an average width W5.

Referring to FIG. 25, automatic ankle cinching system 124 may receive a signal from a sensor that automatic ankle cinching system 124 should be closed. In particular, locking mechanism 2299 may receive a signal to release ankle strap 150. Preferably, coil spring 2204 provides tension to ankle strap 150. At this point, ankle strap 150 may be pulled further into housing 160 and intermediate portion 2209 of ankle strap 150 may be pulled taut against an ankle. In this closed position, entry hole 105 preferably has an average width W6 that is substantially smaller than average width W5.

Referring to FIG. 26, automatic ankle cinching system 124 may be manually opened by a user. In some cases, a user can pull outwards on ankle strap 150 by pulling directly on intermediate portion 2209. In other cases, a user can pull on a lever or tab to open ankle strap 150. At this point, ankle strap 150 may extend further out of housing 160 and intermediate portion 2209 of ankle strap 150 may be loosened around an ankle. Once ankle strap 150 has been full extended into an open position, locking mechanism 2299 may be configured to lock ankle strap 150 in place. In this open position, entry hole 105 preferably has an average width W5 that is substantially larger than average width W6. With this arrangement, a foot may be removed from entry hole 105.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An automatic lacing system for an article of footwear, comprising:

a sole including a cavity;

a motor disposed in the cavity;

the motor including a driveshaft;

the driveshaft including at least one gear;

at least one belt engaged with the at least one gear at an intermediate portion of the belt;

a yoke member connected to the at least one belt at an attachment portion of the at least one belt;

a plurality of straps attached to the yoke member, the plurality of straps being configured to adjust an upper of the article of footwear, wherein the plurality of straps are configured to automatically move between a closed position and a loosened position in response to activating the motor; and at least one sensor configured to determine when the automatic lacing system should be controlled to activate the motor to move the plurality of straps between the closed position and the loosened position.

2. The automatic lacing system of claim 1, further comprising a user control device configured to activate the automatic lacing system upon receiving an input from a user.

3. The automatic lacing system of claim 1, wherein the at least one sensor is a weight sensor; and wherein the weight sensor is located in a portion of the sole of the article of footwear.

4. The automatic lacing system of claim 1, wherein the at least one sensor is a weight sensor; and wherein the weight sensor is located in a sockliner disposed adjacent to the sole within an interior of the upper of the article of footwear.

5. The automatic lacing system of claim 4, wherein the weight sensor is disposed in a heel portion of the sockliner.

6. The automatic lacing system of claim 1, further comprising a sensor configured to provide information related to the tightness of the plurality of straps.

7. The automatic lacing system of claim 6, wherein the sensor configured to provide information related to the tightness of the plurality of straps is associated with the motor.

8. The automatic lacing system of claim 1, further comprising a control system including a central processing unit for controlling activation of the automatic lacing system.

9. The automatic lacing system of claim 8, wherein a signal from the at least one sensor is provided to the control system; and wherein the control system is configured to determine whether to activate the motor to move the plurality of straps between the closed position and the loosened position in response to receiving the signal from the at least one sensor.

10. The automatic lacing system of claim 8, wherein the article of footwear further includes an automatic ankle cinching system, the automatic ankle cinching system comprising:

a housing disposed on a rear portion of an ankle portion of the upper of the article of footwear;

an ankle strap associated with a front portion of the ankle portion;

a strap moving mechanism disposed within the housing;

the ankle strap including a first end portion attached to the strap moving mechanism and a second end portion fixedly attached to the housing;

wherein the strap moving mechanism is configured to automatically move the ankle strap between an open position and a closed position and thereby adjust the ankle portion; and wherein the automatic ankle cinching system includes a locking mechanism that is configured to lock the ankle strap in the open position.

11. The automatic lacing system of claim 10, wherein the ankle cinching system is configured to be operated independently of the automatic lacing system.

12. The automatic lacing system of claim 10, wherein the automatic lacing system is configured to be activated prior to activation of the ankle cinching system.

13. The automatic lacing system of claim 10, wherein the control system is configured to operate the ankle cinching system and the automatic lacing system approximately simultaneously.

14. The automatic lacing system of claim 10, wherein the at least one sensor is a weight sensor; and wherein the control system is configured to receive a signal from the weight sensor to determine whether to activate the automatic lacing system and the ankle cinching system.

15. The automatic lacing system of claim 1, wherein an intermediate portion of the plurality of straps is configured to pass through a sidewall portion of the upper; and wherein the sidewall portion of the upper comprises at least one provision to reduce friction between the intermediate portion of the plurality of straps and the sidewall portion.

16. An automatic lacing system for an article of footwear, comprising:

a strap moving mechanism;

at least one strap attached to the strap moving mechanism, the at least one strap being configured to adjust an upper of the article of footwear;

an upper of the article of footwear, the upper including a sidewall portion;

the sidewall portion of the upper configured to receive an intermediate portion of the at least one strap;

wherein the intermediate portion is contracted within the sidewall portion when the at least one strap is closed and wherein the intermediate portion is extended outside of the sidewall portion when the at least one strap is open;

wherein the strap moving mechanism further comprises:

a motor including a driveshaft;

the driveshaft including a gear;

a belt configured to engage the gear; and wherein the belt is configured to supply power to the at least one strap.

17. The automatic lacing system of claim 16, wherein the sidewall portion of the upper comprises at least one provision to reduce friction between the intermediate portion of the at least one strap and the sidewall portion.

18. The automatic lacing system of claim 17, wherein the sidewall portion comprises at least one channel disposed in a lining of the upper that is configured to receive and guide the at least one strap.

19. The automatic lacing system of claim 18, wherein the lining is coated to present a substantially low friction surface for the at least one strap.

20. The automatic lacing system of claim 17, wherein the sidewall portion includes at least one flexible tube configured to receive the at least one strap.

* * * * *